US006538615B1

(12) United States Patent
Schantz

(10) Patent No.: US 6,538,615 B1
(45) Date of Patent: Mar. 25, 2003

(54) SEMI-COAXIAL HORN ANTENNA

(75) Inventor: Hans G. Schantz, Huntsville, AL (US)

(73) Assignee: Time Domain Corporation, Huntsville, AL (US)

( * ) Notice: Subject to any disclaimer, the term of this patent is extended or adjusted under 35 U.S.C. 154(b) by 0 days.

(21) Appl. No.: 09/651,282

(22) Filed: Aug. 30, 2000

Related U.S. Application Data

(60) Provisional application No. 60/205,415, filed on May 19, 2000.

(51) Int. Cl.[7] ..... H01Q 13/00

(52) U.S. Cl. ..... 343/786; 343/773

(58) Field of Search ..... 343/786, 773, 343/791, 772, 702, 700 MS

(56) References Cited

U.S. PATENT DOCUMENTS

| | | | | | |
|---|---|---|---|---|---|
| 2,454,766 | A | * | 11/1948 | Brillouin | 343/773 |
| 4,641,317 | A | | 2/1987 | Fullerton | 375/1 |
| 4,743,906 | A | | 5/1988 | Fullerton | 342/27 |
| 4,813,057 | A | | 3/1989 | Fullerton | 375/37 |
| 4,979,186 | A | | 12/1990 | Fullerton | 375/23 |
| 4,996,535 | A | * | 2/1991 | Profera, Jr. | 343/786 |
| 5,363,108 | A | | 11/1994 | Fullerton | 342/27 |
| 5,440,316 | A | * | 8/1995 | Podgorski et al. | 343/786 |
| 5,617,105 | A | * | 4/1997 | Tsunekawa et al. | 343/702 |
| 5,677,927 | A | | 10/1997 | Fullerton et al. | 375/200 |
| 5,687,169 | A | | 11/1997 | Fullerton | 370/324 |
| 5,798,736 | A | * | 8/1998 | Hall | 343/791 |
| 6,081,170 | A | * | 9/1998 | Enokuma | 333/134 |
| 5,832,035 | A | | 11/1998 | Fullerton | 375/210 |
| 5,952,954 | A | | 9/1999 | Beckner | 342/22 |
| 5,973,653 | A | | 10/1999 | Kragalott et al. | 343/786 |

FOREIGN PATENT DOCUMENTS

EP 197 29 684 A1 2/1999 ..... H01Q/1/38

OTHER PUBLICATIONS

P.R. Foster et al., "A Wideband Balun from Coaxial Line To TEM Line", *Antennas and Propagation*, IEE Conference Publication No. 407, Apr. 4–7, 1996, pp. 286–290.

Pozar, D.M., *Microwave Engineering*, Addison–Wesley, (1990), pp. 251–299.

Pen Shan–Cheng, et al., "Mutal Coupling Between Triangular Microstrip Antenna on a Cylindrical Body,"IEE, Electronic Letters, vol. 33, No. 12, Jun. 5, 1997.

Meeks, D.M., et al., "Imput Impedence of a Wraparound Microstrip Antenna on a Conical Surface," IEEE, IEEE Antenna amd Propagation Society International Symposium 1996 Digest, vol. 1, pp. 676–679.

Copy of International Search Report, Application No. PCT/US01/15982, issued Oct. 1, 2001, 8 pages.

* cited by examiner

*Primary Examiner*—Don Wong
*Assistant Examiner*—James Clinger
(74) *Attorney, Agent, or Firm*—Sterne, Kessler, Goldstein & Fox P.L.L.C.

(57) ABSTRACT

A semi-coaxial horn antenna transmits and receives electromagnetic waves, including impulse radio waves. The antenna includes an inner conductor that is surrounded by a cone-shaped dielectric, and an outer conductor that is conformally attached to the cone shaped dielectric. In embodiments, the inner conductor is a hollow metallic cylinder that is able to slide over a separate metal shaft, which may be part of a portable hand-tool device. The dielectric constant of the cone shaped dielectric may be selected to match a target medium. The outer conductor has a cross-section that is substantially an arc shape, and defines a sector angle $\phi$ that determines an impedance along the length of the antenna.

53 Claims, 35 Drawing Sheets

IMPULSE RADIO RECEIVER
702
RECEIVED SIGNAL
739
DETECTOR
738
S/H
736
PULSE SUM
735
734
SUBCARRIER DEMODULATOR
732
712
LOCK LOOP FILTER
742
744
RX TIME BASE
718
716
RX ANTENNA
706
704
708
710
TEMPLATE
728
730
726
PRECISION TIMING GENERATOR
714
720
CODE SOURCE
722
724

TX ANTENNA
624
626
PULSE GENERATOR
622
618
INFORMATION SOURCE
620
616
PRECISION TIMING GENERATOR
608
614
CODE SOURCE
612
610
TX TIME BASE
604
606
602
IMPULSE RADIO TRANSMITTER

VIEW B FOR SCH 1200

CROSS SECTION OF A 30 Ω AIR GAP STRIP LINE IN THE COMPLEX 'Z' PLANE

CROSS SECTION OF A 30 Ω AIR GAP COAXIAL LINE IN THE COMPLEX 'W' PLANE

UNEQUAL COPLANAR LINES

UNEQUAL COPLANAR TRANSMISSION LINE GEOMETRY WHICH YIELDS A 50 Ω CHARACTERISTIC IMPEDANCE

CONFORMAL MAPPING FROM CO-PLANAR TO PARALLEL LINES

VIEW C–C′
(SCH CROSS–SECTION)

TEMPLATE FOR ~1" SCH TRANSDUCER WITH ELEMENT SIZED USING IMPEDANCE CALCULATION OFF BY A FACTOR OF TWO.

SMA CONNECTOR ATTACHMENT WITH PARALLEL CAPACITOR

PCB DIRECT FEED

MATCH TO 50 Ω ALONG THE SCH. THE UPPER AND LOWER LINES SHOW 10% (i.e ±5 Ω LIMITS)
GYPSUM DATA IS TAKEN FROM SCH-6, EPOXY DATA FROM SCH-5,7,8.

PATTERN MEASUREMENT OF SCH-6 ELEMENT #1, HORIZONTAL PLANE, VERTICAL POLARIZATION.

SEMI-COAXIAL HORN ANTENNA

This application claims the benefit of the U.S. Provisional Application No. 60/205,415, filed on May 19, 2000.

BACKGROUND OF THE INVENTION

1. Field of the Invention

The present invention generally relates to antennas, and more specifically to a semi-coaxial horn antenna.

2. Related Art

The radio transmission of both analog and digital information has normally been effected by one of two methods. In one, referred to as an amplitude modulation, the amplitude of a continuous sinusoidal carrier signal is modulated according to an information signal. When the amplitude modulated signal is received at a receiving location, the reverse process (that is, demodulation of the carrier) is preformed to recover the information signal. The other method employs what is termed frequency modulation. In frequency modulation, the frequency of the carrier signal is modulated in accordance with the information signal. During demodulation, circuitry is employed that performs frequency discrimination, which converts frequency variations in the carrier signal to an amplitude output that is in accordance with the original modulation. In both systems, the continuous sinusoidal carrier occupies a distinctive frequency bandwidth, or channel. This channel occupies spectrum space during transmission, which should not be utilized for other signal transmissions if interference is to be avoided.

In today's communications environment, frequency spectrum is in short supply and is very crowded. According, there is a tremendous need for some method of expanding the availability of frequency spectrum for increased communications. In furtherance thereof, new methods and systems of communications have been developed that employ a wider frequency spectrum, rather than discrete frequency channels, for radio communications links. More specifically, new methods and systems of communications have been developed that utilize wide band or ultra wide band (UWB) technology, which is also called impulse radio communications herein.

Basic impulse radio transmitters emit short pulses approaching a Gaussian monocycle with tightly controlled pulse-to-pulse intervals. Impulse radio systems typically use pulse position modulation (also referred to as digital time shift modulation). Pulse position modulation is a form of time modulation where the value of each instantaneous sample of a modulating signal varies the position of a pulse in time. More specifically, in pulse position modulation, the pulse-to-pulse interval is typically varied on a pulse-by-pulse basis by two components: a pseudo-random code component and an information component. That is, when coding is used each pulse is shifted by a coding amount, and information modulation is accomplished by shifting the coded time position by an additional amount (that is, in addition to PN code dither) in response to an information signal. This additional amount (that is, the information modulation dither) is typically very small relative to the PN code shift. For example, in a 10 mega pulse per second (Mpps) system with a center frequency of 2 GHz, the PN code may command pulse position variations over a range of 100 nsec; whereas, the information modulation may only deviate the pulse position by 150 ps (which is typically less then the wavelength of a pulse).

The impulse radio receiver is a homodyne receiver with a cross correlator front end. The front end coherently converts an electromagnetic pulse train of monocycle pulses to a baseband signal in a single stage. The baseband signal is the basic information channel for the basic impulse radio communications system, and is also referred to as the information bandwidth. The data rate of the impulse radio transmission is only a fraction of the periodic timing signal used as a time base. Each data bit time position modulates many pulses of the periodic timing signal. This yields a modulated, coded timing signal that comprises a train of identical pulses for each single data bit. The cross correlator of the impulse radio receiver integrates multiple pulses to recover the transmitted information.

Ultra wide-band (UWB) communications systems, such as impulse radio, pose very substantial requirements on antennas. Many antennas are highly resonant and have operating bandwidths of only a few percent. Therefore, when a substantial frequency change is made, then it becomes necessary to select a different antenna that has different dimensions. Such "tuned," narrow bandwidth antennas may be entirely satisfactory or even desirable for single frequency or narrow band applications. In many situations, however, wider bandwidths may be required.

Conventional UWB antennas with wide bandwidths are physically large antennas, and thus impractical for most common uses. In other words, the physical size of conventional UWB antennas can be a problem in applications that require a portable system that utilizes a conventional UWB antenna.

For these reasons, many in the ultra wide-band communications environment have recognized a need for an improved antenna having wide-band performance in a sufficiently small package size that is portable.

SUMMARY OF THE INVENTION

The present invention is directed to an ultra wide-band semi-coaxial horn (SCH) antenna that is capable of transmitting and receiving impulse radio waves. The SCH antenna includes an inner conductor that is surrounded by a substantially cone-shaped dielectric, and an outer conductor that is conformally attached to the cone-shaped dielectric. The inner conductor has a substantially circular cross-section, and the outer conductor has substantially arc-shaped cross-section. The cross-section of the outer conductor defines a sector angle $\phi$ that varies along a length of the antenna to provide a desired impedance profile from an input of the antenna to an output of the antenna. In embodiments, the impedance profile is substantially constant along the length of the SCH antenna, thereby minimizing VSWR when matched to a system impedance. Alternatively, various non-constant impedance profiles can be implemented.

In embodiments, the outer conductor is the radiating conductor, and the inner conductor provides a ground for the radiating conductor. Alternatively, the roles can be reversed so that the inner conductor is the radiating conductor and the outer conductor provides a ground and a backplane for the inner conductor.

In embodiments, the inner conductor is a hollow cylinder that is able to slide over a separate shaft. The separate shaft can be part of a handtool device. Alternatively, the inner conductor can be a solid cylinder.

In embodiments, the SCH antenna includes two (or more) outer conductors, at least one for transmit operations and one for receive operations.

In embodiments, the SCH antenna is the antenna for an object finder system that detects objects behind a wall, a barrier, or other medium. In these embodiments, the dielectric of the SCH antenna can be selected to substantially match the dielectric of the target medium.

In embodiments, the dielectric is extended beyond the outer conductor so as to form a dielectric lens at the output of the semi-coaxial horn antenna.

Further features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE EMBODIMENTS

1. Impulse Radio Basics

Figure 1A:
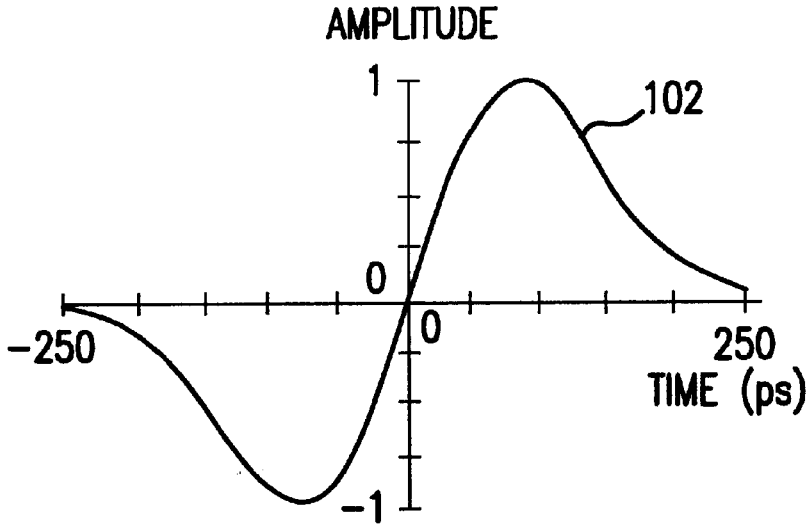
FIG. 1A illustrates a representative Gaussian Monocycle waveform in the time domain.

This section is directed to technology basics and provides the reader with an introduction to impulse radio concepts, as well as other relevant aspects of communications theory. This section includes subsections relating to waveforms, pulse trains, coding for energy smoothing and channelization, modulation, reception and demodulation, interference resistance, processing gain, capacity, multipath and propagation, distance measurement, and qualitative and quantitative characteristics of these concepts. It should be understood that this section is provided to assist the reader with understanding the present invention, and should not be used to limit the scope of the present invention.

Impulse radio communications was first fully described in a series of patents, including U.S. Pat. Nos. 4,641,317 (issued Feb. 3, 1987), 4,813,057 (issued Mar. 14, 1989), 4,979,186 (issued Dec. 18, 1990) and 5,363,108 (issued Nov. 8,1994) to Larry W. Fullerton. A second generation of impulse radio patents include U.S. Pat. Nos. 5,677,927 (issued Oct. 14, 1997), 5,687,169 (issued Nov. 11, 1997) and 5,832,035 (issued Nov. 3, 1998) to Fullerton et al. Each of these patent documents are incorporated herein by reference.

Impulse radio refers to a radio system based on short, low duty cycle pulses. An ideal impulse radio waveform is a short Gaussian monocycle. As the name suggests, this waveform attempts to approach one cycle of radio frequency (RF) energy at a desired center frequency. Due to implementation and other spectral limitations, this waveform may be altered significantly in practice for a given application. Most waveforms with enough bandwidth approximate a Gaussian shape to a useful degree.

Impulse radio can use many types of modulation, including AM, time shift (also referred to as pulse position) and M-ary versions. The time shift method has simplicity and power output advantages that make it desirable. In this document, the time shift method is used as an illustrative example.

In impulse radio communications, the pulse-to-pulse interval can be varied on a pulse-by-pulse basis by two components: an information component and a pseudo-random code component. Generally, conventional spread spectrum systems make use of pseudo-random codes to spread the normally narrow band information signal over a relatively wide band of frequencies. A conventional spread spectrum receiver correlates these signals to retrieve the original information signal. Unlike conventional spread spectrum systems, the pseudo-random code for impulse radio communications is not necessary for energy spreading because the monocycle pulses themselves have an inherently wide bandwidth. Instead, the pseudo-random code is used for channelization, energy smoothing in the frequency domain, resistance to interference, and reducing the interference potential to nearby receivers.

The impulse radio receiver is typically a direct conversion receiver with a cross correlator front end in which the front end coherently converts an electromagnetic pulse train of monocycle pulses to a baseband signal in a single stage. The baseband signal is the basic information signal for the impulse radio communications system. It is often found desirable to include a subcarrier with the baseband signal to help reduce the effects of amplifier drift and low frequency noise. The subcarrier that is typically implemented alternately reverses modulation according to a known pattern at a rate faster than the data rate. This same pattern is then used to reverse the process and restore the original data pattern just before detection. This method permits alternating current (AC) coupling of stages, or equivalent signal processing to eliminate direct current (DC) drift and errors from the detection process. This method is described in detail in U.S. Pat. No. 5,677,927 to Fullerton et al.

In impulse radio communications utilizing time shift modulation, each data bit typically time position modulates many pulses of the periodic timing signal. This yields a modulated, coded timing signal that comprises a train of identically shaped pulses for each single data bit. The impulse radio receiver integrates multiple pulses to recover the transmitted information.

1.1 Waveforms

Impulse radio refers to a radio system based on short, low duty cycle pulses. In the widest bandwidth embodiment, the resulting waveform approaches one cycle per pulse at the center frequency. In more narrow band embodiments, each pulse consists of a burst of cycles usually with some spectral shaping to control the bandwidth to meet desired properties such as out of band emissions or in-band spectral flatness, or time domain peak power or burst off time attenuation. For system analysis purposes, it is convenient to model the desired waveform in an ideal sense to provide insight into the optimum behavior for detail design guidance. One such waveform model that has been useful is the Gaussian monocycle as shown in FIG. 1A. This waveform is representative of the transmitted pulse produced by a step function into an ultra-wideband antenna. The basic equation normalized to a peak value of 1 is as follows:

$$f_{mono}(t) = \sqrt{e}\left(\frac{t}{\sigma}\right)e^{\frac{-t^2}{2\sigma^2}}$$

Where,

σ is a time scaling parameter, t is time, $f_{mono}$(t) is the waveform voltage, and e is the natural logarithm base.

Figure 1B:
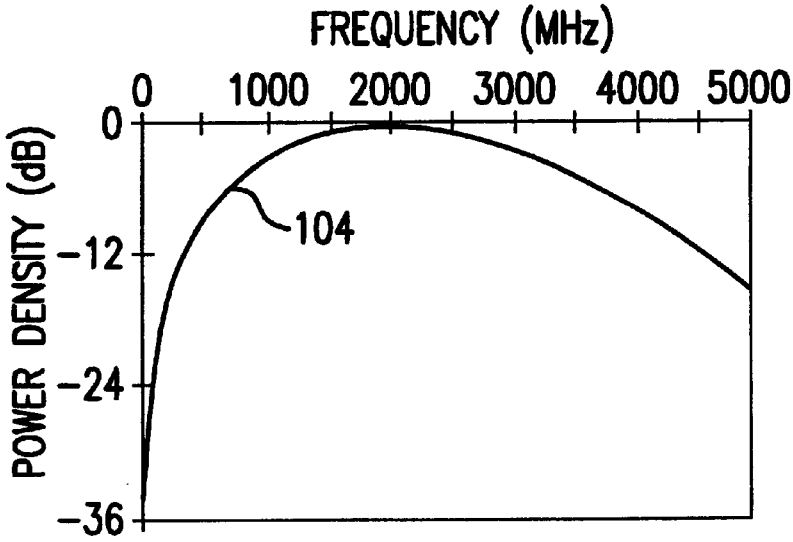
FIG. 1B illustrates the frequency domain amplitude of the Gaussian Monocycle of FIG. 1A.

The frequency domain spectrum of the above waveform is shown in FIG. 1B. The corresponding equation is:

$$F_{mono}(f) = (2\pi)^{\frac{3}{2}}\sigma f e^{-2(\pi\sigma f)^2}$$

The center frequency ($f_c$), or frequency of peak spectral density is:

$$f_c = \frac{1}{2\pi\sigma}$$

These pulses, or bursts of cycles, may be produced by methods described in the patents referenced above or by other methods that are known to one of ordinary skill in the art. Any practical implementation will deviate from the ideal mathematical model by some amount. In fact, this deviation from ideal may be substantial and yet yield a system with acceptable performance. This is especially true for microwave implementations, where precise waveform shaping is difficult to achieve. These mathematical models are provided as an aid to describing ideal operation and are not intended to limit the invention, In fact, any burst of cycles that adequately fills a given bandwidth and has an adequate on-off attenuation ratio for a given application will serve the purpose of this invention.

1.2 Pulse Trains

Impulse radio systems can deliver one or more data bits per pulse; however, impulse radio systems more typically use pulse trains, not single pulses, for each data bit. As described in detail in the following example system, the impulse radio transmitter produces and outputs a train of pulses for each bit of information.

Figure 2A:
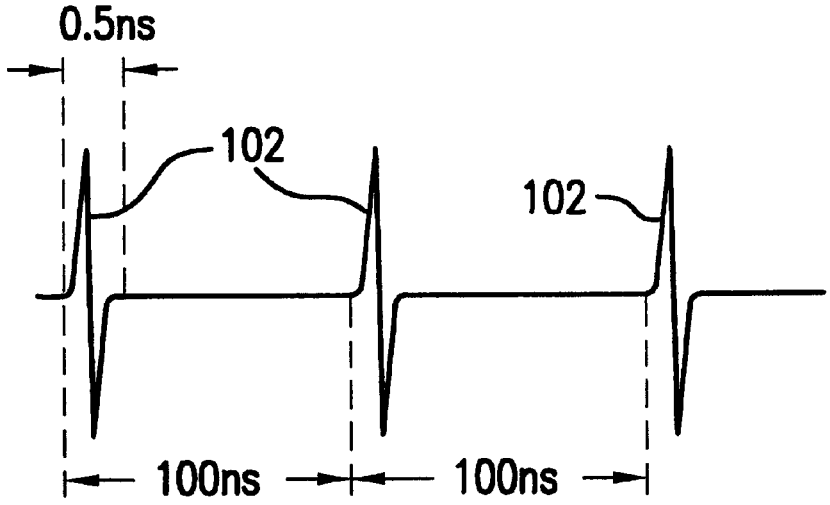
FIG. 2A illustrates a pulse train comprising pulses as in FIG. 1A.
Figure 2B:
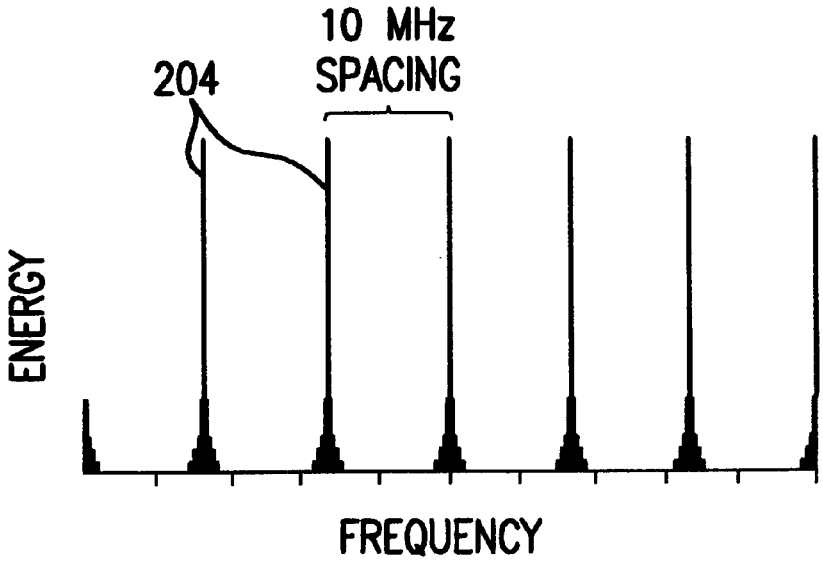
FIG. 2B illustrates the frequency domain amplitude of the waveform of FIG. 2A.

Prototypes built by the inventors have pulse repetition frequencies including 0.7 and 10 megapulse per second (Mpps, where each megapulse is $10^6$ pulses). FIGS. 2A and 2B are illustrations of the output of a typical 10 Mpps system with uncoded, unmodulated, 0.5 nanosecond (nsec) pulses 102. FIG. 2A shows a time domain representation of this sequence of pulses 102. FIG. 2B, which shows 60 MHZ at the center of the spectrum for the waveform of FIG. 2A, illustrates that the result of the pulse train in the frequency domain is to produce a spectrum comprising a set of comb lines 204 spaced at the frequency of the 10 Mpps pulse repetition rate. When the full spectrum is shown, the envelope of the line spectrum follows the curve of the single pulse spectrum 104 of FIG. 1B. For this simple uncoded case, the power of the pulse train is spread among roughly two hundred comb lines. Each comb line thus has a small fraction of the total power and presents much less of an interference problem to receiver sharing the band.

It can also be observed from FIG. 2A that impulse radio systems typically have very low average duty cycles resulting in average power significantly lower than peak power. The duty cycle of the signal in the present example is 0.5%, based on a 0.5 nsec pulse in a 100 nsec interval.

1.3 Coding for Energy Smoothing and Channelization

For high pulse rate systems, it may be necessary to more finely spread the spectrum than is achieved by producing comb lines. This may be done by pseudo-randomly positioning each pulse relative to its nominal position.

Figure 3:
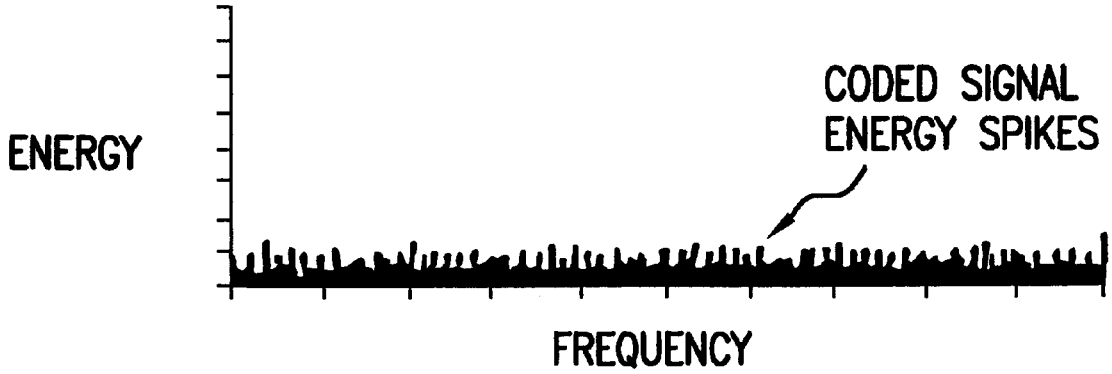
FIG. 3 illustrates the frequency domain amplitude of a sequence of time coded pulses.

FIG. 3 is a plot illustrating the impact of a pseudo-noise (PN) code dither on energy distribution in the frequency domain (A pseudo-noise, or PN code is a set of time positions defining the pseudo-random positioning for each pulse in a sequence of pulses). FIG. 3, when compared to FIG. 2B, shows that the impact of using a PN code is to destroy the comb line structure and spread the energy more uniformly. This structure typically has slight variations which are characteristic of the specific code used.

The PN code also provides a method of establishing independent communication channels using impulse radio. PN codes can be designed to have low cross correlation such that a pulse train using one code will seldom collide on more than one or two pulse positions with a pulses train using another code during any one data bit time. Since a data bit may comprise hundreds of pulses, this represents a substantial attenuation of the unwanted channel.

1.4 Modulation

Any aspect of the waveform can be modulated to convey information. Amplitude modulation, phase modulation, frequency modulation, time shift modulation and M-ary versions of these have been proposed. Both analog and digital forms have been implemented. Of these, digital time shift modulation has been demonstrated to have various advantages and can be easily implemented using a correlation receiver architecture.

Digital time shift modulation can be implemented by shifting the coded time position by an additional amount (that is, in addition to PN code dither) in response to the information signal. This amount is typically very small relative to the PN code shift. In a 10 Mpps system with a center frequency of 2 GHz., for example, the PN code may command pulse position variations over a range of 100 nsec; whereas, the information modulation may only deviate the pulse position by 150 ps.

Thus, in a pulse train of n pulses, each pulse is delayed a different amount from its respective time base clock position by an individual code delay amount plus a modulation amount, where n is the number of pulses associated with a given data symbol digital bit.

Modulation further smooths the spectrum, minimizing structure in the resulting spectrum.

1.5 Reception and Demodulation

Clearly, if there were a large number of impulse radio users within a confined area, there might be mutual interference. Further, while the PN coding minimizes that interference, as the number of users rises, the probability of an individual pulse from one user's sequence being received simultaneously with a pulse from another user's sequence increases. Impulse radios are able to perform in these environments, in part, because they do not depend on receiving every pulse. The impulse radio receiver performs a correlating, synchronous receiving function (at the RF level) that uses a statistical sampling and combining of many pulses to recover the transmitted information.

Impulse radio receivers typically integrate from 1 to 1000 or more pulses to yield the demodulated output. The optimal number of pulses over which the receiver integrates is dependent on a number of variables, including pulse rate, bit rate, interference levels, and range.

1.6 Interference Resistance

Besides channelization and energy smoothing, the PN coding also makes impulse radios highly resistant to interference from all radio communications systems, including other impulse radio transmitters. This is critical as any other signals within the band occupied by an impulse signal potentially interfere with the impulse radio. Since there are currently no unallocated bands available for impulse systems, they must share spectrum with other conventional radio systems without being adversely affected. The PN code helps impulse systems discriminate between the intended impulse transmission and interfering transmissions from others.

Figure 4:
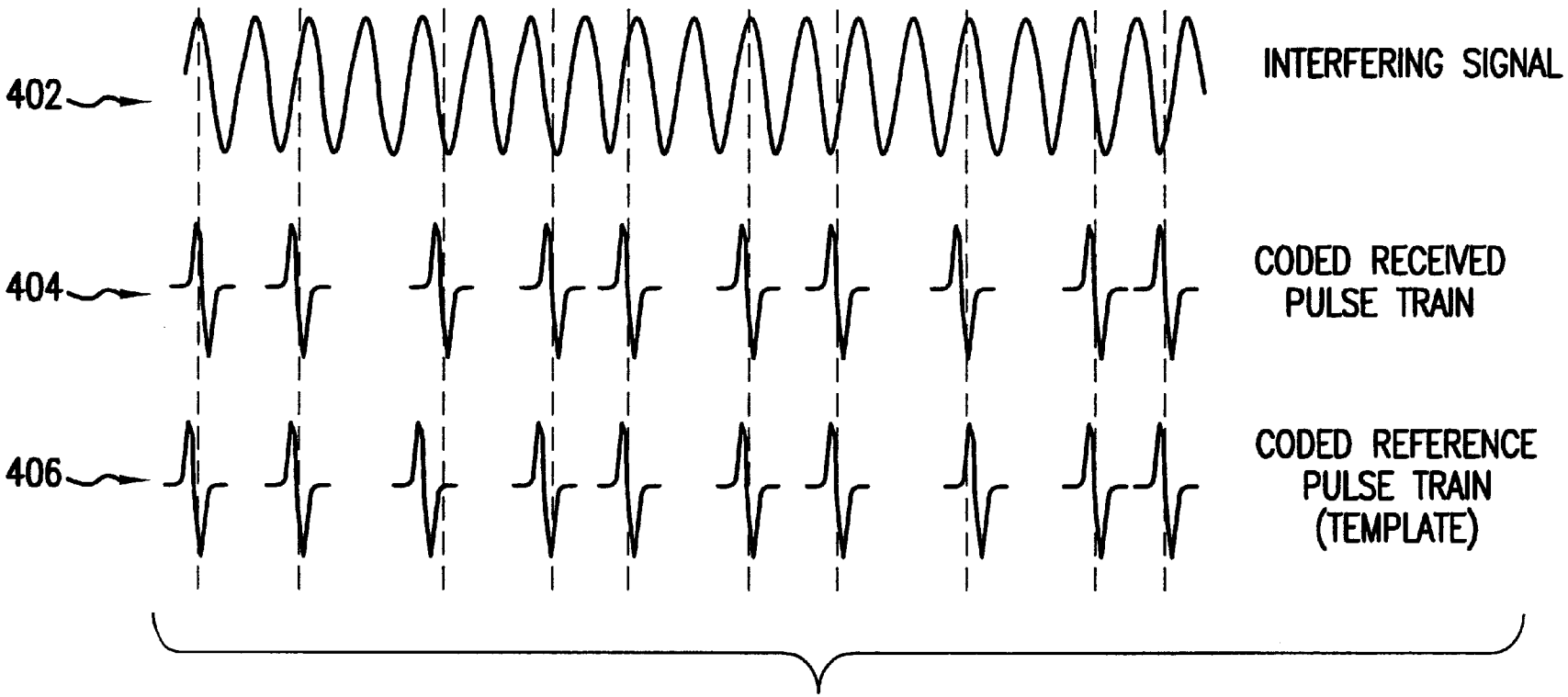
FIG. 4 illustrates a typical received signal and interference signal.

FIG. 4 illustrates the result of a narrow band sinusoidal interference signal 402 overlaying an impulse radio signal 404. At the impulse radio receiver, the input to the cross correlation would include the narrow band signal 402, as well as the received ultrawide-band impulse radio signal 404. The input is sampled by the cross correlator with a PN dithered template signal 406. Without PN coding, the cross correlation would sample the interfering signal 402 with such regularity that the interfering signals could cause significant interference to the impulse radio receiver. However, when the transmitted impulse signal is encoded with the PN code dither (and the impulse radio receiver template signal 406 is synchronized with that identical PN code dither) the correlation samples the interfering signals pseudo-randomly. The samples from the interfering signal add incoherently, increasing roughly according to square root of the number of samples integrated; whereas, the impulse radio samples add coherently, increasing directly according to the number of samples integrated. Thus, integrating over many pulses overcomes the impact of interference.

1.7 Processing Gain

Impulse radio is resistant to interference because of its large processing gain. For typical spread spectrum systems, the definition of processing gain, which quantifies the decrease in channel interference when wide-band communications are used, is the ratio of the bandwidth of the channel to the bit rate of the information signal. For example, a direct sequence spread spectrum system with a 10 kHz information bandwidth and a 10 MHZ channel bandwidth yields a processing gain of 1000 or 30 dB. However, far greater processing gains are achieved with impulse radio systems, where for the same 10 kHz information bandwidth is spread across a much greater 2 GHz channel bandwidth, the theoretical processing gain is 200,000 or 53 dB.

1.8 Capacity

It has been shown theoretically, using signal to noise arguments, that thousands of simultaneous voice channels are available to an impulse radio system as a result of the exceptional processing gain, which is due to the exceptionally wide spreading bandwidth.

For a simplistic user distribution, with N interfering users of equal power equidistant from the receiver, the total interference signal to noise ratio as a result of these other users can be described by the following equation:

$$V_{tot}^2 = \frac{N\sigma^2}{\sqrt{Z}}$$

Where, $V^2_{tot}$ is the total interference signal to noise ratio variance, at the receiver, N is the number of interfering users, $\sigma^2$ is the signal to noise ratio variance resulting from one of the interfering signals with a single pulse cross correlation, and Z is the number of pulses over which the receiver integrates to recover the modulation.

This relationship suggests that link quality degrades gradually as the number of simultaneous users increases. It also shows the advantage of integration gain. The number of users that can be supported at the same interference level increases by the square root of the number of pulses integrated.

1.9 Multipath and Propagation

One of the striking advantages of impulse radio is its resistance to multipath fading effects. Conventional narrow band systems are subject to multipath through the Rayleigh fading process, where the signals from many delayed reflections combine at the receiver antenna according to their relative phase. This results in possible summation or possible cancellation, depending on the specific propagation to a given location. This also results in potentially wild signal strength fluctuations in mobile applications, where the mix of multipath signals changes for every few feet of travel.

Figure 5A:
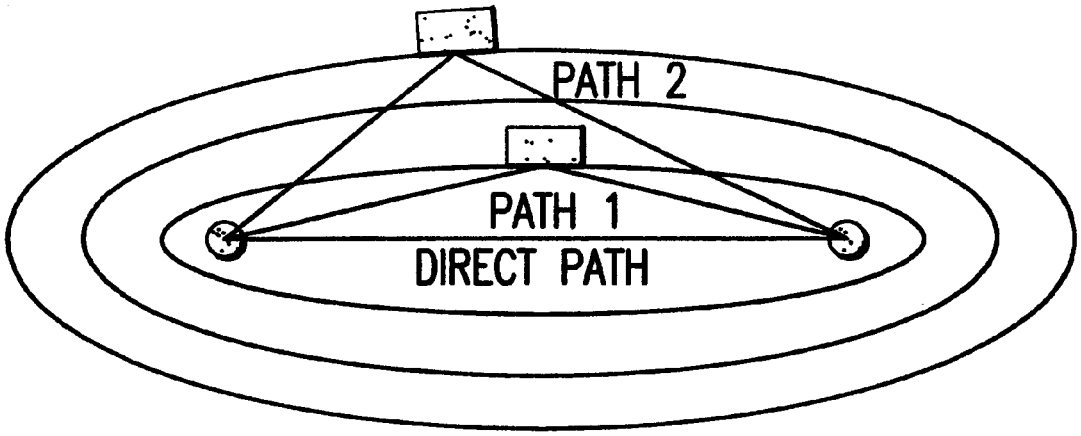
FIG. 5A illustrates a typical geometrical configuration giving rise to multipath received signals.

Impulse radios, however, are substantially resistant to these effects. Impulses arriving from delayed multipath reflections typically arrive outside of the correlation time and thus are ignored. This process is described in detail with reference to FIGS. 5A and 5B. In FIG. 5A, three propagation paths are shown. The direct path is the shortest. It represents the straight line distance between the transmitter and the receiver. Path 1 represents a grazing multipath reflection, which is very close to the direct path. Path 2 represents a distant multipath reflection. Also shown are elliptical (or, in space, ellipsoidal) traces that represent other possible locations for reflections with the same time delay.

Figure 5B:
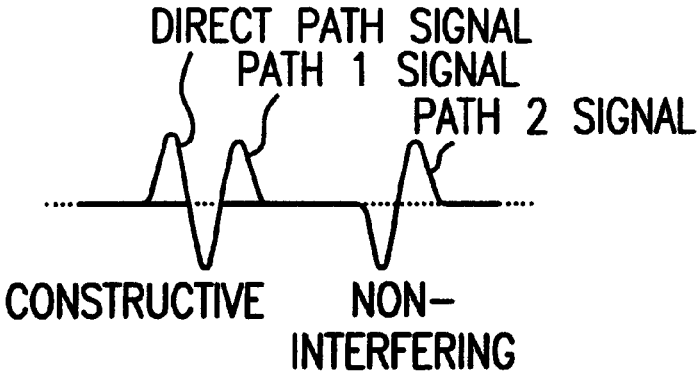
FIG. 5B illustrates exemplary multipath signals in the time domain.

FIG. 5B represents a time domain plot of the received waveform from this multipath propagation configuration. This figure comprises three doublet pulses as shown in FIG. 1A. The direct path signal is the reference signal and represents the shortest propagation time. The path 1 signal is delayed slightly and actually overlaps and enhances the signal strength at this delay value. Note that the reflected waves are reversed in polarity. The path 2 signal is delayed sufficiently that the waveform is completely separated from the direct path signal. If the correlator template signal is positioned at the direct path signal, the path 2 signal will produce no response. It can be seen that only the multipath signals resulting from very close reflectors have any effect. The bulk of the multipath signals, which are substantially delayed, are removed from the correlation process and are ignored.

The multipath signals delayed less than one quarter wave (one quarter wave is about 1.5 inches, or 3.5 cm at 2 GHz center frequency) are the only signals that will attenuate the direct path signal. This is the reflection from the first Fresnel zone, and this property is shared with narrow band signals; however, impulse radio is highly resistant to all other Fresnel zone reflections. The ability to avoid the highly variable attenuation from multipath gives impulse radio significant performance advantages.

1.10 Distance Measurement

Impulse systems can measure distances to extremely fine resolution because of the absence of ambiguous cycles in the waveform. Narrow band systems, on the other hand, are limited to the modulation envelope and cannot easily distinguish precisely which RF cycle is associated with each data bit because the cycle-to-cycle amplitude differences are so small they are masked by link or system noise. Since the impulse radio waveform has no multi-cycle ambiguity, this allows positive determination of the waveform position to less than a wavelength-potentially, down to the noise floor of the system. This time position measurement can be used to measure propagation delay to determine link distance, and once link distance is known, to transfer a time reference to an equivalently high degree of precision. The inventors of the present invention have built systems that have shown the potential for centimeter distance resolution, which is equivalent to about 30ps of time transfer resolution. See, for example, commonly owned, co-pending applications Ser. No. 09/045,929, filed Mar. 23, 1998, titled "Ultrawide-Band Position Determination System and Method", and 09/083,993, filed May 26, 1998, titled "System and Method for Distance Measurement by In phase and Quadrature Signals in a Radio System", both of which are incorporated herein by reference.

1.11 Exemplary Transmitter

Figures 6, 7:
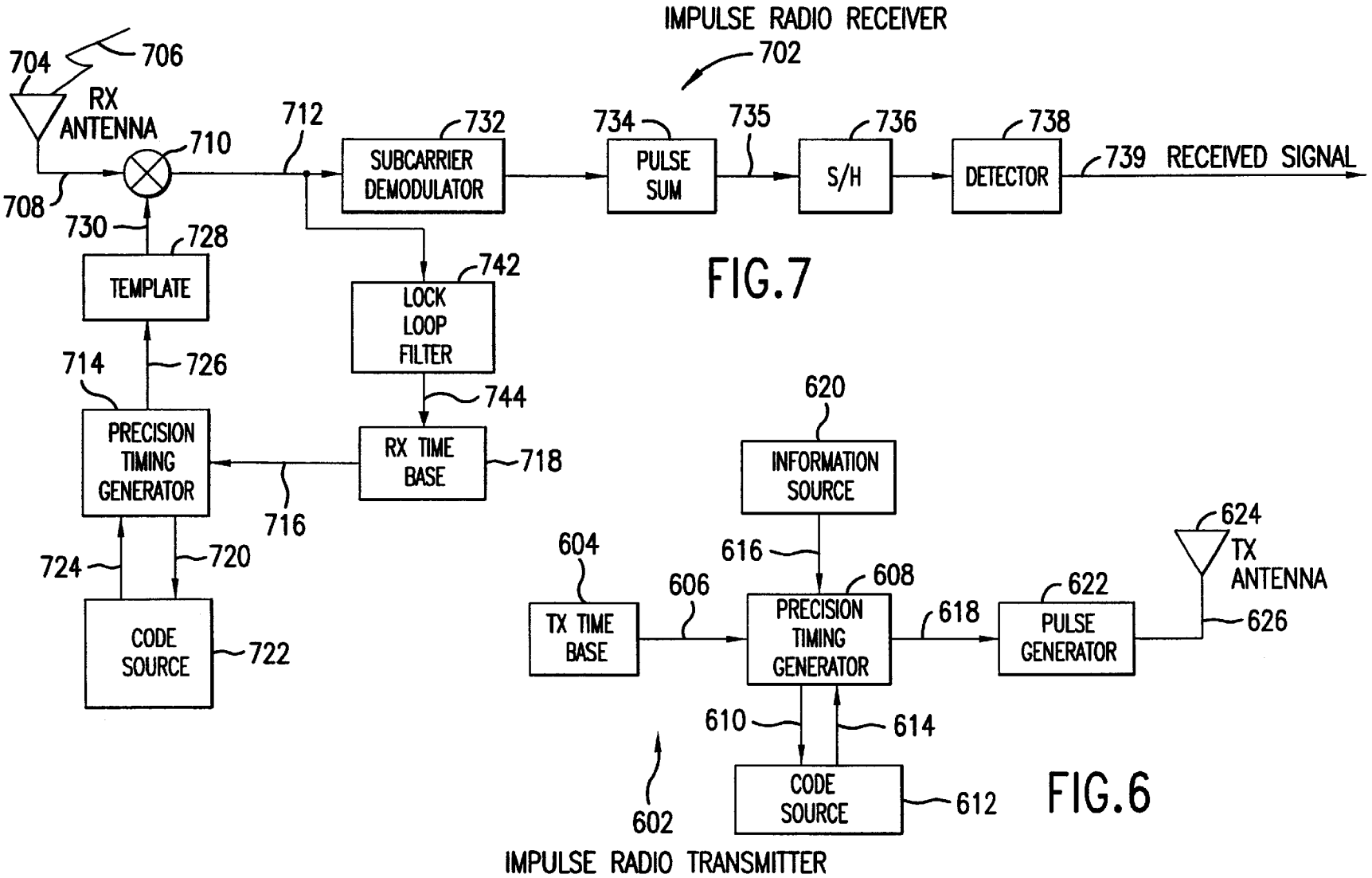
FIG. 6 is a functional diagram of an exemplary ultra wide band impulse radio transmitter.
FIG. 7 is a functional diagram of an exemplary ultra wide band impulse radio receiver.

An exemplary embodiment of an impulse radio transmitter 602 of an impulse radio communication system having one subcarrier channel will now be described with reference to FIG. 6.

The transmitter 602 comprises a time base 604 that generates a periodic timing signal 606. The time base 604 typically comprises a voltage controlled oscillator (VCO), or the like, having a high timing accuracy and low jitter, on the order of picoseconds (ps). The voltage control to adjust the VCO center frequency is set at calibration to the desired center frequency used to define the transmitter's nominal pulse repetition rate. The periodic timing signal 606 is supplied to a precision timing generator 608.

The precision timing generator 608 supplies synchronizing signals 610 to the code source 612 and utilizes the code source output 614 together with an internally generated subcarrier signal (which is optional) and an information signal 616 to generate a modulated, coded timing signal 618.

The code source 612 comprises a storage device such as a random access memory (RAM), read only memory (ROM), or the like, for storing suitable PN codes and for outputting the PN codes as a code signal 614. Alternatively, maximum length shift registers or other computational means can be used to generate the PN codes.

An information source 620 supplies the information signal 616 to the precision timing generator 608.The information signal 616 can be any type of intelligence, including digital bits representing voice, data, imagery, or the like, analog signals, or complex signals.

A pulse generator 622 uses the modulated, coded timing signal 618 as a trigger to generate output pulses. The output pulses are sent to a transmit antenna 624 via a transmission line 626 coupled thereto. The output pulses are converted into propagating electromagnetic pulses by the transmit antenna 624. In the present embodiment, the electromagnetic pulses are called the emitted signal, and propagate to an impulse radio receiver 702. such as shown in FIG. 7, through a propagation medium, such as air, in a radio frequency embodiment. In a preferred embodiment, the emitted signal is wide-band or ultrawide-band, approaching a monocycle pulse as in FIG. 1A. However, the emitted signal can be spectrally modified by filtering of the pulses. This filtering will usually cause each monocycle pulse to have more zero crossings (more cycles) in the time domain. In this case, the impulse radio receiver can use a similar waveform as the template signal in the cross correlator for efficient conversion.

1.12 Exemplary Receiver

An exemplary embodiment of an impulse radio receiver 702 (hereinafter called the receiver) for the impulse radio communication system is now described with reference to FIG. 7. More specifically, the system illustrated in FIG. 7 is for reception of digital data wherein one or more pulses are transmitted for each data bit.

The receiver 702 comprises a receive antenna 704 for receiving a propagated impulse radio signal 706. A received signal 708 from the receive antenna 704 is coupled to a cross correlator or sampler 710 to produce a baseband output 712. The cross correlator or sampler 710 includes multiply and integrate functions together with any necessary filters to optimize signal to noise ratio.

The receiver 702 also includes a precision timing generator 714, which receives a periodic timing signal 716 from a receiver time base 718. This time base 718 is adjustable and controllable in time, frequency, or phase, as required by the lock loop in order to lock on the received signal 708. The precision timing generator 714 provides synchronizing signals 720 to the code source 722 and receives a code control signal 724 from the code source 722. The precision timing generator 714 utilizes the periodic timing signal 716 and code control signal 724 to produce a coded timing signal 726. The template generator 728 is triggered by this coded timing signal 726 and produces a train of template signal pulses 730 ideally having waveforms substantially equivalent to each pulse of the received signal 708. The code for receiving a given signal is the same code utilized by the originating transmitter 602 to generate the propagated signal 706. Thus, the timing of the template pulse train 730 matches the timing of the received signal pulse train 708, allowing the received signal 708 to be synchronously sampled in the correlator 710. The correlator 710 ideally comprises a multiplier followed by a short term integrator to sum the multiplier product over the pulse interval. Further examples and details of correlation and sampling processes can be found in commonly owned patents U.S. Pat. Nos. 4,641,317, 4,743,906, 4,813,057, and 4979,186, which are incorporated herein by reference, and commonly owned and copending application 09/356,384, filed Jul. 16, 1999, titled: "Baseband Signal Converter Device for a Wideband Impulse Radio Receiver," which is incorporated herein by reference.

The output of the correlator 710, also called a baseband signal 712, is coupled to a subcarrier demodulator 732, which demodulates the subcarrier information signal from the subcarrier. The purpose of the optional subcarrier process, when used, is to move the information signal away from DC (zero frequency) to improve immunity to low frequency noise and offsets. The output of the subcarrier demodulator 732 is then filtered or integrated in a pulse summation stage 734. The pulse summation stage produces an output representative of the sum of a number of pulse signals comprising a single data bit. The output of the pulse summation stage 734 is then compared with a nominal zero (or reference) signal output in a detector stage 738 to determine an output signal 739 representing an estimate of the original information signal 616.

The baseband signal 712 is also input to a lowpass filter 742 (also referred to as lock loop filter 742). A control loop comprising the lowpass filter 742, time base 718, precision timing generator 714, template generator 728, and correlator 710 is used to generate a filtered error signal 744. The filtered error signal 744 provides adjustments to the adjustable time base 718 to time position the periodic timing signal 726 in relation to the position of the received signal 708.

In a transceiver embodiment, substantial economy can be achieved by sharing part or all of several of the functions of the transmitter 602 and receiver 702. Some of these include the time base 718, precision timing generator 714, code source 722, antenna 704, and the like.

2. Example Environment

Before describing the invention in detail, it is useful to describe an example environment for the invention. Description of this example environment is provided for convenience only, and is not intended to limit the invention in any way. In fact, after reading the invention description, it will become apparent to a person skilled in the relevant arts how to implement the invention in alternate environments than that described herein.

Figure 8:
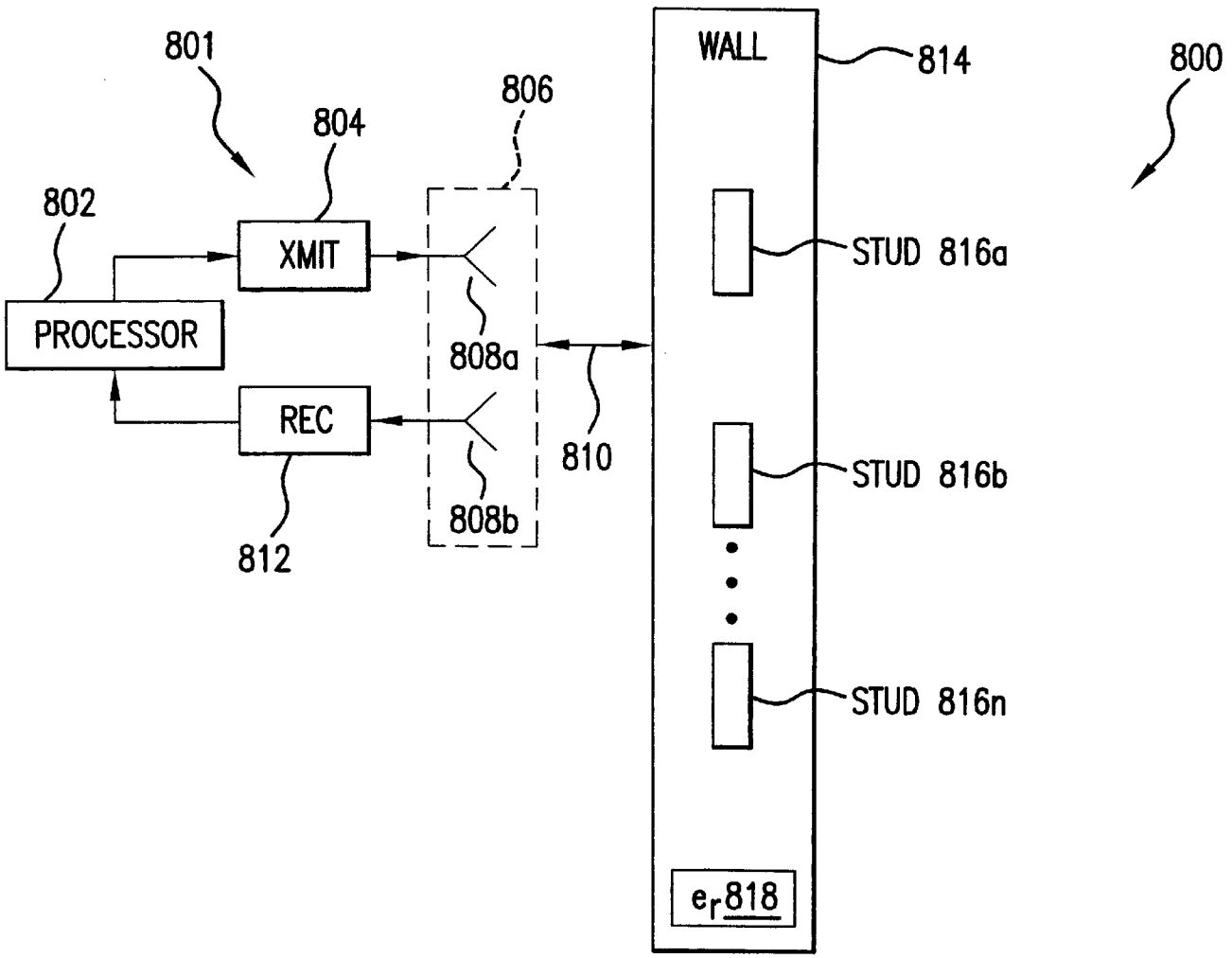
FIG. 8 illustrates an object finder system, according to embodiments of the invention.

FIG. 8 illustrates an example environment 800 that includes an objectfinder 801 for detecting objects 816*a–n* in a wall 814. Exemplary objects include, but are not limited to: wall studs, nails, wires, or other objects that may be concealed in or behind a wall. Object finder 801 includes: a processor 802, a transmitter 804, a receiver 812, and an antenna assembly 806. The antenna assembly 806 includes a transmit antenna 808*a* and a receive antenna 808*b*. The wall is made of a medium (or material) that has a dielectric constant $e_r$ 818.

The object finder 801 operates as follows.

The transmitter 804 generates a transmit signal that is radiated by the transmit antenna 808*a*. In embodiments, the transmitter 804 is similar to the transmitter 602 that is shown in FIG. 6 and described above. As such, the transmit signal includes Gaussian monocycle pulses that are described herein, and shown in FIG. 1A.

The transmit antenna 808*a* launches the transmit signal into the wall 814.

The receiver 812 detects any signal reflection from the objects 816 that are picked up by the receive antenna 808*b*. In embodiments, the receiver 812 is similar to the receiver 702 that is shown in FIG. 7, and described above.

The processor 802 monitors the transmit and receive pulses in order to identify and/or determine the proximity of any objects 816 in the wall 814. The identity and/or location of multiple objects in the wall can be accurately determined by scanning the entire surface area of the wall.

Figure 9:
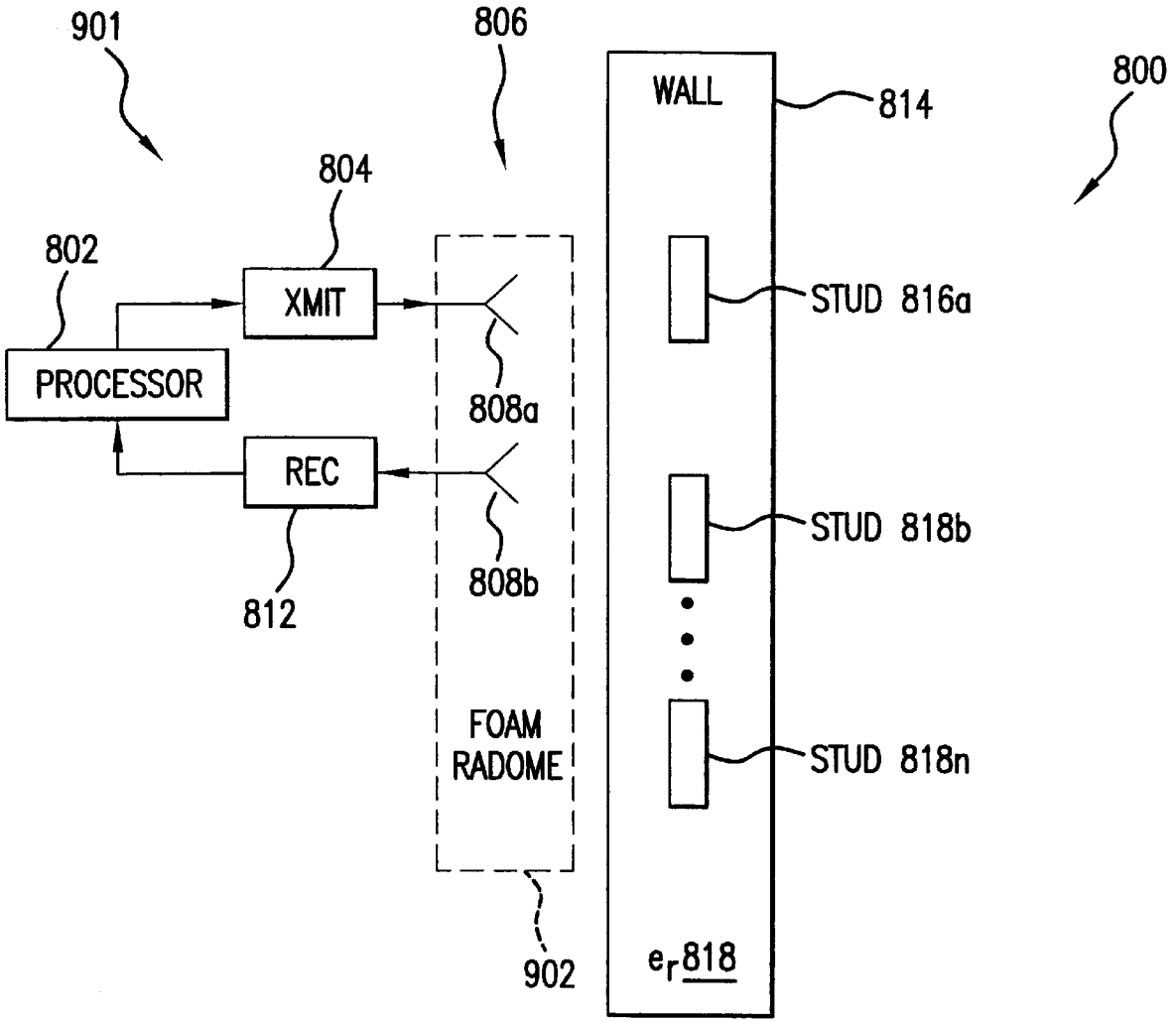
FIG. 9 illustrates an object finder system, where the antenna assembly is encased in a foam dielectric, according to embodiments of the invention.

During scanning, in embodiments, the object finder 801 is placed a distance 810 from the surface of the wall 814. In alternate embodiments, the antenna assembly 806 includes a radome 902 that encloses the transmit and receive antennas 808, as shown in FIG. 9. The radome 902 can be fabricated using a foam material. In which case, the object finder 801 can be placed flush against the wall 814 during scanning.

Figure 10:
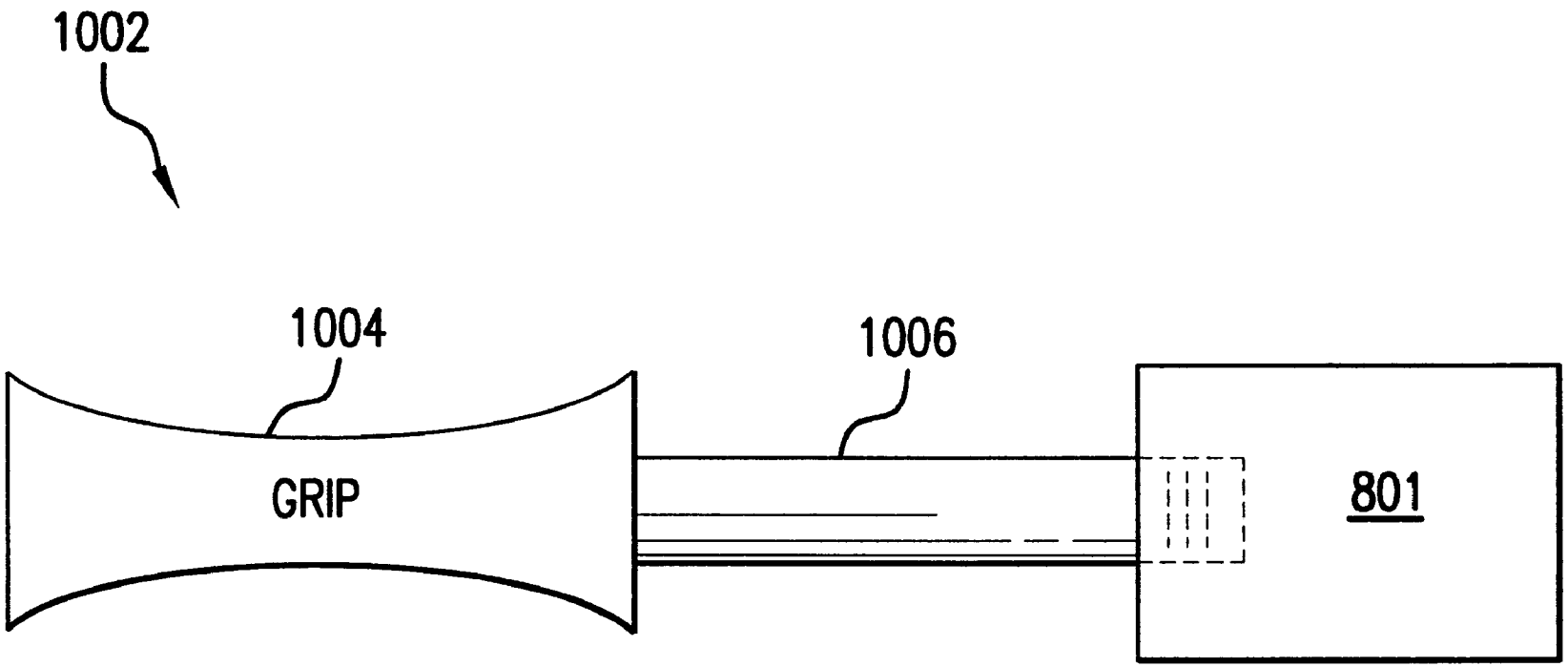
FIG. 10 illustrates a handtool 1002 that can be utilized to carry the object finder system 801, according to embodiments of the present invention.

In embodiments, it is highly desirable for the object finder 801 to be a portable, hand-held device. More specifically, it is desirable for the object finder 801 to be approximately the size of a hand-tool that can be carried in a standard tool belt. FIG. 10 illustrates a hand-tool 1002 having a grip 1004, a shaft 1006, and the object finder 801 that is attached to the end of the shaft 1006. This will allow a worker to carry the hand tool 1002 in a standard tool belt, allowing easy accessibility when a wall stud, etc. needs to be located.

The antenna assembly 806 primarily defines the form factor of the object finder 801 because the processor 802, the transmitter 804, and the receiver 812 can be implemented as one or more semiconductor integrated circuits. Therefore, what is needed is a compact antenna assembly design that can efficiently launch an electromagnetic (EM) signal into a medium for object detection.

3. Semi-Coaxial Horn Antenna

Figure 11A:
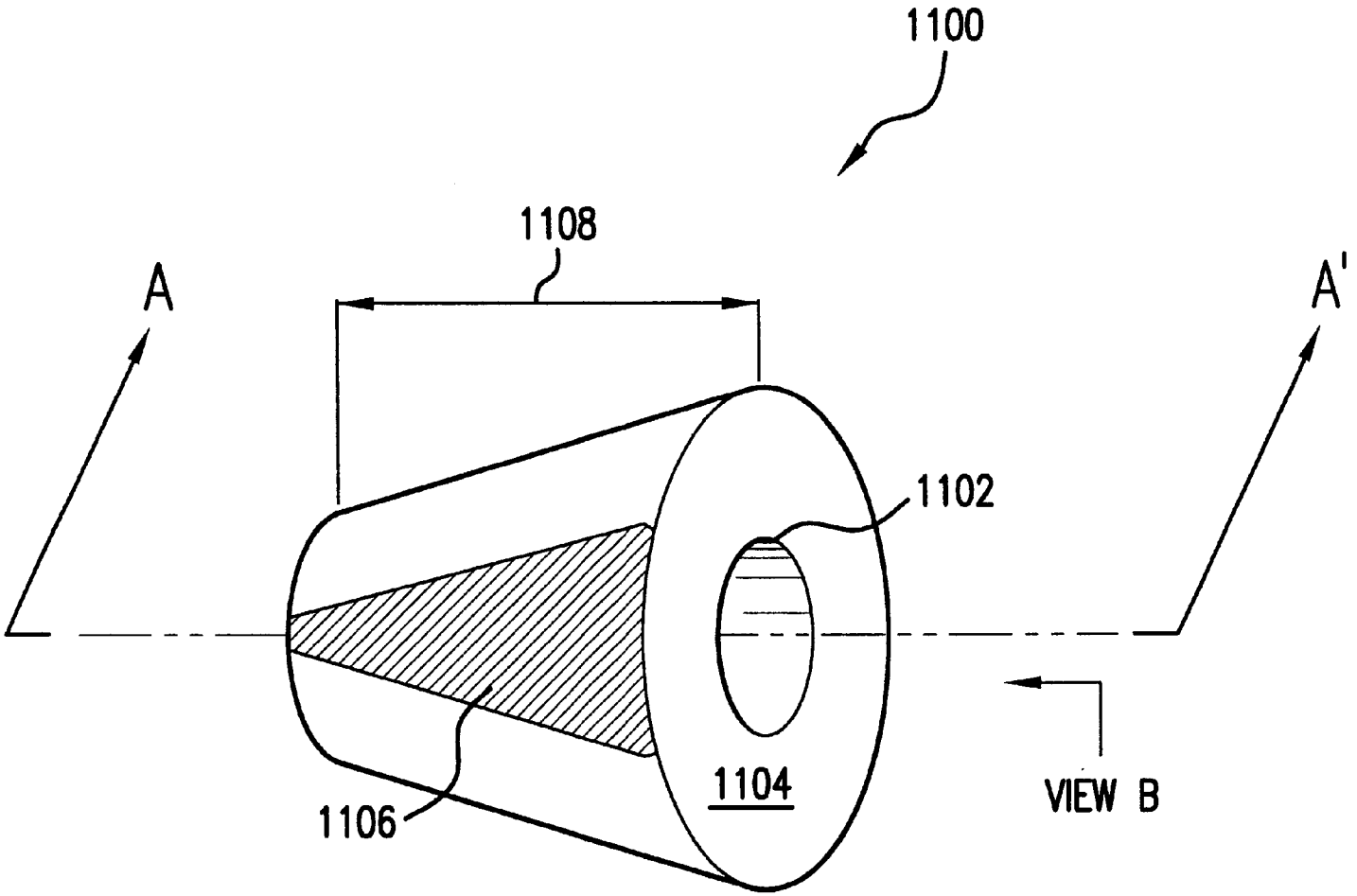
FIGS. 11A–D illustrate a semi-coaxial horn (SCH) antenna 1100, according to embodiments of the invention.

FIGS. 11A–D illustrate a semi-coaxial horn (SCH) antenna 1100 that is useful for transmitting and receiving EM signals, including the impulse radio signals that were described above. Referring to FIG. 11A, the SCH antenna 1100 includes an inner conductor 1102, a cone shaped dielectric 1104, and an outer conductor 1106.

The inner conductor 1102 is a ground reference for the outer conductor 1106, which is the radiating conductor for the SCH antenna 1100. The terms "ground" and "radiating", as used herein, are meant for ease of conductor identification only, and are not intended to limit the conductors' functions or to preclude other embodiments in which the roles of the conductors are different.

In embodiments, the inner conductor 1102 is a hollow metallic cylinder that extends the length of the SCH antenna 1100. Alternatively, the inner conductor 1102 can be a solid metallic cylinder. When the inner conductor 1102 is hollow, it can slip over (or screw on) the metal shaft of a hand-tool, such as the shaft 1006 that is shown in FIG. 10. In embodiments, the clearance of the hollow cylinder 1102 is ½", which is sufficient for most hand-tool applications. Also, the inner conductor 1102 shields the outer conductor 1106 from any idiosyncrasies of the shaft geometry. Exemplary materials for the inner conductor 1102 include brass, aluminum, steel, etc. or any other metallic or semi-metallic material that will provide a sufficient electrical ground at the frequency of interest.

The dielectric 1104 is substantially cone shaped, and defines the outer dimensions of the SCH antenna 1100. In embodiments, the dielectric 1104 is selected so that the dielectric constant is substantially matched to the dielectric constant of the target medium, such as $e_r$ 818 that is associated with the wall 814 in FIG. 8. Exemplary dielectrics include but are not limited to: epoxy resin having a relative dielectric constant of 4.7; and gypsum that is formed from plaster of Paris and having a relative dielectric constant of 5.5. The gypsum dielectric provides a good match to gypsum drywall.

The outer conductor 1106 is conformally attached to the outer surface of the dielectric 1104, and has a substantially triangular shape. The material for the outer conductor 1106 can be any type of metallic or semi-metallic conductor that has sufficient conductivity for the signal frequency range. In embodiments, the outer conductor 1106 is a thin metal foil that attached to the outer surface of the cone shaped dielectric 1104. Exemplary types of foil include but are not limited to copper foil, and aluminum foil.

Figure 11B:
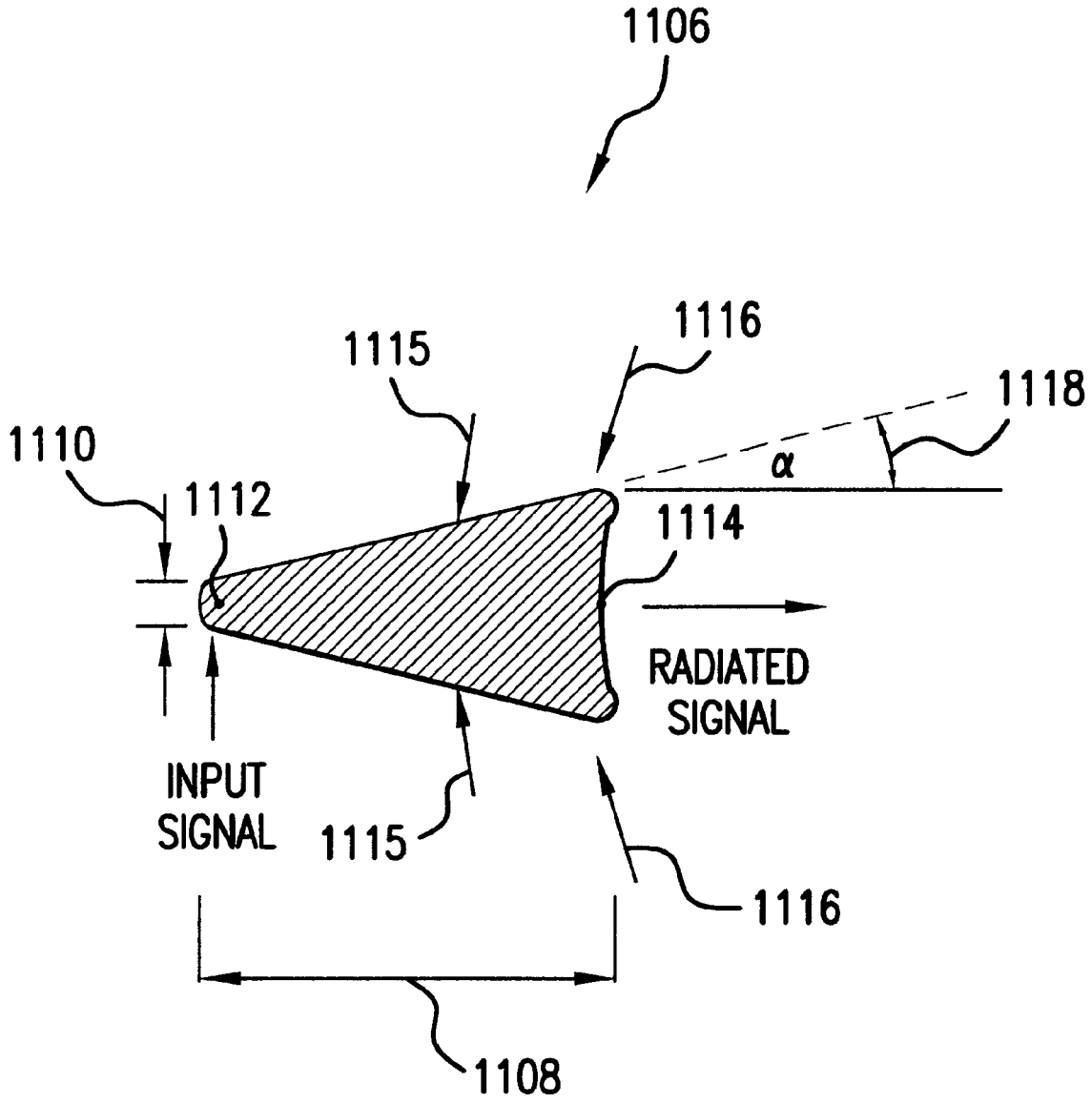

FIG. 11B further illustrates the shape of the outer conductor 1106, where the outer conductor 1106 has a substantially triangular shape from an input 1112 to an output 1114. (The input/output designation in FIG. 11B assumes a transmit mode configuration where an EM signal is radiated from the output 1114. However, the SCH antenna 1100 is reciprocal and operates just as well in receive mode, as will be understood by those skilled in the relevant arts.) The length 1108 of the outer conductor 1106 is flexible, and can be adapted to meet specific form factor requirements. In embodiments, the length 1108 is substantially a ¼ wavelength at the frequency of interest. For example, at 3 Ghz, the conductor 1106 has an approximate length of 2.5 cm (or 1 inch). Other lengths 1108 (besides ¼ wavelength) can be utilized, and are within the scope and spirit of the present invention, including but not limited to lengths that are greater than a ¼ wavelength, and lengths that are less than a ¼ wavelength.

Still referring to FIG. 11B, the outer conductor 1106 traces out an arc 1115 that varies along the length 1108 of the SCH antenna 1100. The slope of the arc 1115 forms a corresponding flare angle $\alpha$ 1118 as shown. The arc 1115 substantially determines the impedance for the conductor 1106 along the length of the SCH antenna, for a given thickness of the dielectric 1104. To achieve a constant impedance along the SCH antenna, the arc 1115 continuously and linearly increases from a small arc 1110 at the signal input 1112 to a large arch 1116 at the signal output 1114, since the thickness of the dielectric also linearly increases along the length of the SCH antenna. Therefore, the flare angle $\alpha$ 1118 is constant along the length of the conductor 1106 to produce a constant impedance along the length of the SCH antenna. In certain applications, a constant impedance is desirable to match an overall system impedance, resulting in a low VSWR. Alternatively, the flare angle $\alpha$ 1118 can be varied along the length of the SCH antenna to produce a desired impedance profile, such as an increasing or decreasing impedance profile. Non-constant impedance profiles are described further in following sections.

In embodiments of the invention, the arc length of the outer conductor 1106 is configured to approximately track the increasing thickness of the dielectric from the input 1112 to the output 1114, which results in a flare angle of approximately 17 degrees. In other embodiments, flare angles of 25 degrees to 75 degree are utilized.

In embodiments of the invention, the edges of the conductor 1106 are "rounded-off" at the output 1114, as shown in FIG. 11B. This can improve impedance match.

Figure 11C:
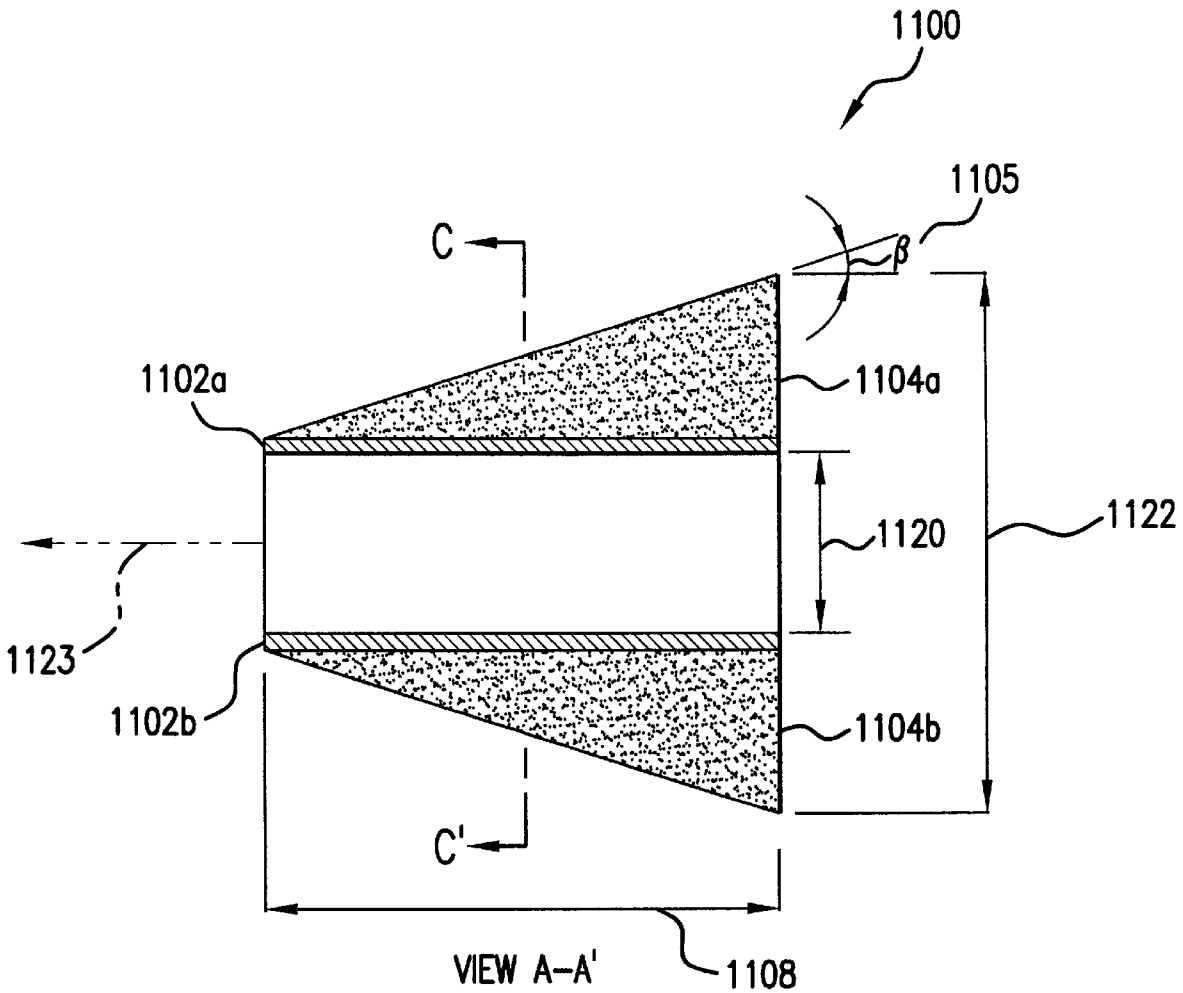

FIG. 11C illustrates a cross-section view A–A' of the SCH antenna 1100 that is shown in FIG. 11A. The cross-section view clearly shows the inner conductor 1102 as a hollow cylinder around a center axis 1123 that travels the length of the SCH 1100, where the inner conductor 1102 has an inner diameter or clearance 1120. The cross-section view also shows the dielectric 1104 as having an increasing thickness to produce to the cone shape, and reaching an outer diameter 1122. (Note that the outer conductor 1106 is not shown in view A–A' because of where the cut was made, but would be shown if the SCH antenna 1100 was rotated about the axis 1123.)

FIG. 11C also illustrates a half flare angle $\beta$ 1105 for the dielectric cone 1104, which characterizes the flare of the dielectric cone 1104. If the dielectric 1104 is chosen to match the dielectric constant of a target medium (e.g. $e_r$ 818 for the wall 814 in FIG. 8), then the half flare angle $\beta$ 1105 can be chosen to substantially match the critical angle for total internal reflection at the interface of the target medium (e.g. wall 814). By doing so, energy from the SCH antenna 1100 will refract outward to fill the entire field of view on the other side of the target medium.

Figure 11D:
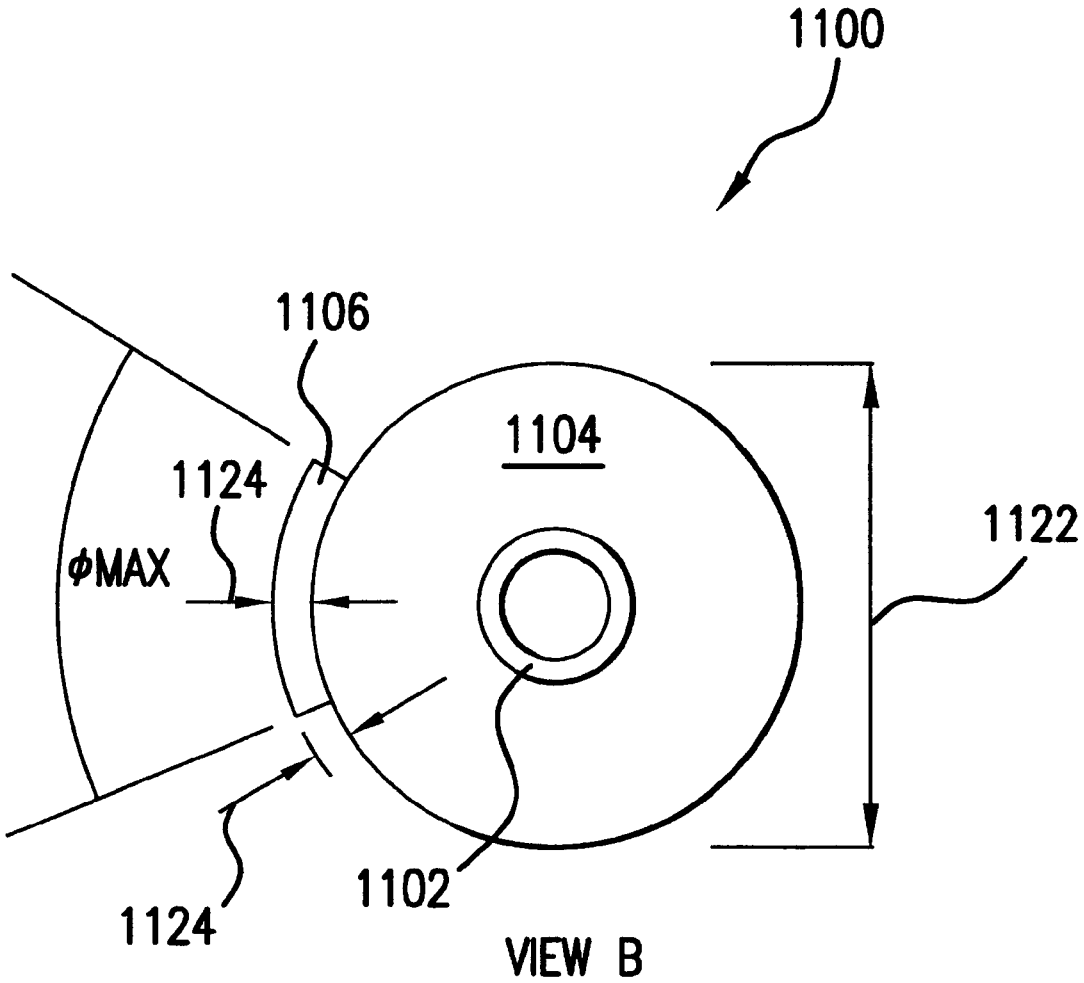

FIG. 11D shows an end view B of the SCH antenna 1100. End view B clearly shows the inner conductor 1102 and the outer diameter 1122 of the dielectric 1104. The end view B also shows the outer conductor 1106 having a thickness 1124. The thickness 1124 is exaggerated in FIG. 11D for ease of illustration. In other words, the outer conductor 1106 can be relatively thin compared to the thickness of the dielectric 1104. The outer conductor 1106 sweeps out a maximum sector angle $\phi_{MAX}$ as shown at the end of the SCH antenna. The sector angle $\phi$ is discussed more generally in the cross-section description that follows.

Figure 19:
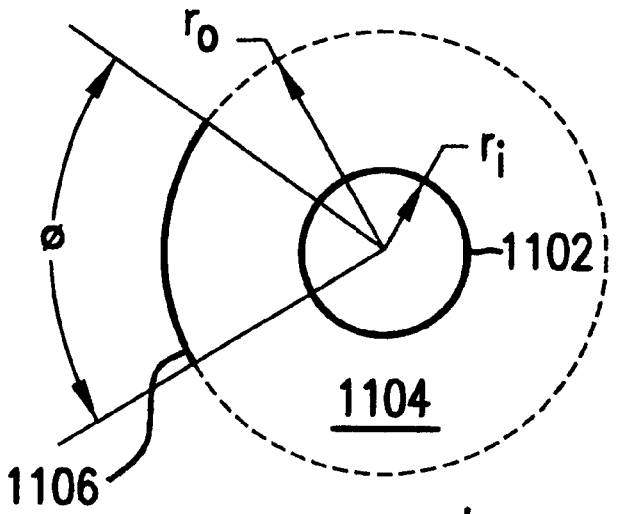
FIG. 19 illustrates the geometry cross-section of a SCH antenna, according to embodiments of the invention.

FIG. 19 illustrates a cross-section (or cut view) of the SCH antenna 1100, which is view C–C' in FIG. 11C. The outer conductor 1106 sweeps out the sector angle $\phi$ that varies along the length 1108 of the SCH antenna 1100, and which is related to the flare angle $\alpha$ and the arc 1115 according to geometry principles. As will be discussed herein, the sector angle $\phi$ determines an impedance along the antenna SCH 1100, along with other parameters (such as dielectric constant and thickness). In embodiments, the sector angle $\phi$ is continuously varied so as to maintain a constant impedance along the length 1108 of the SCH antenna 1100. For example, given a dielectric having a thickness that increases at a linear rate, (as shown in FIG. 11C), the sector angle $\phi$ also increases at a linear rate to maintain a constant impedance along the length of the SCH antenna. Alternatively, non-constant impedance profiles can be achieved for the SCH antenna by altering the sector angle variation along the length of the SCH antenna, from that described in FIG. 11A. Non-constant impedance profiles are discussed further in the following section.

3a. Non-Constant Impedance Profiles

Figure 30:
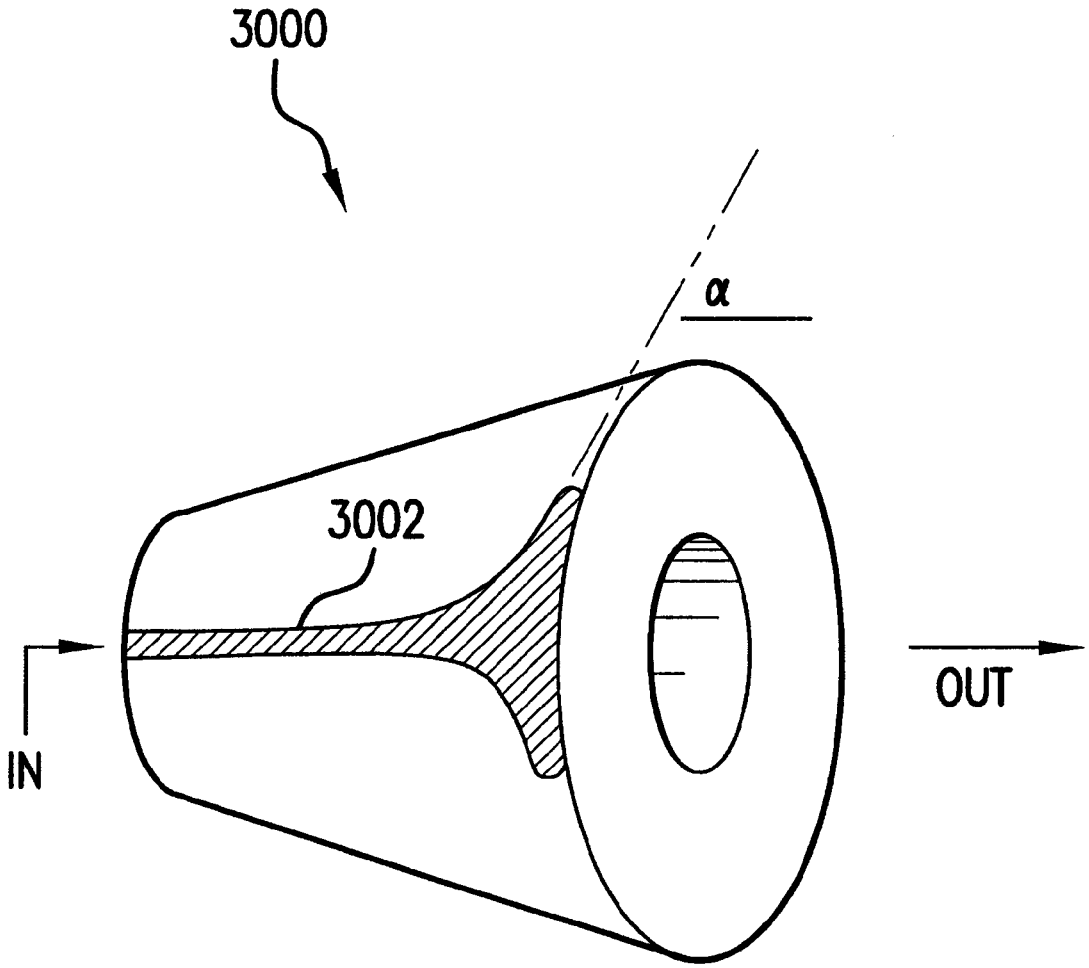
FIG. 30 illustrates a SCH antenna with a decreasing impedance profile, according to embodiments of the present invention.

The flare angle $\alpha$ (and therefore the sector angle $\phi$ of the SCH outer conductor can be varied along the length of the SCH antenna to produce a desired impedance profile, such as an increasing or decreasing impedance profile. FIG. 30 illustrates a SCH antenna 3000 having an outer conductor 3002 with a flare angle $\alpha$ that increases in a non-linear fashion along the length of the SCH antenna 3000. The resulting impedance profile decreases from the input to the output of the SCH antenna 3000 during the non-linear portion of the conductor 3002.

Figure 31:
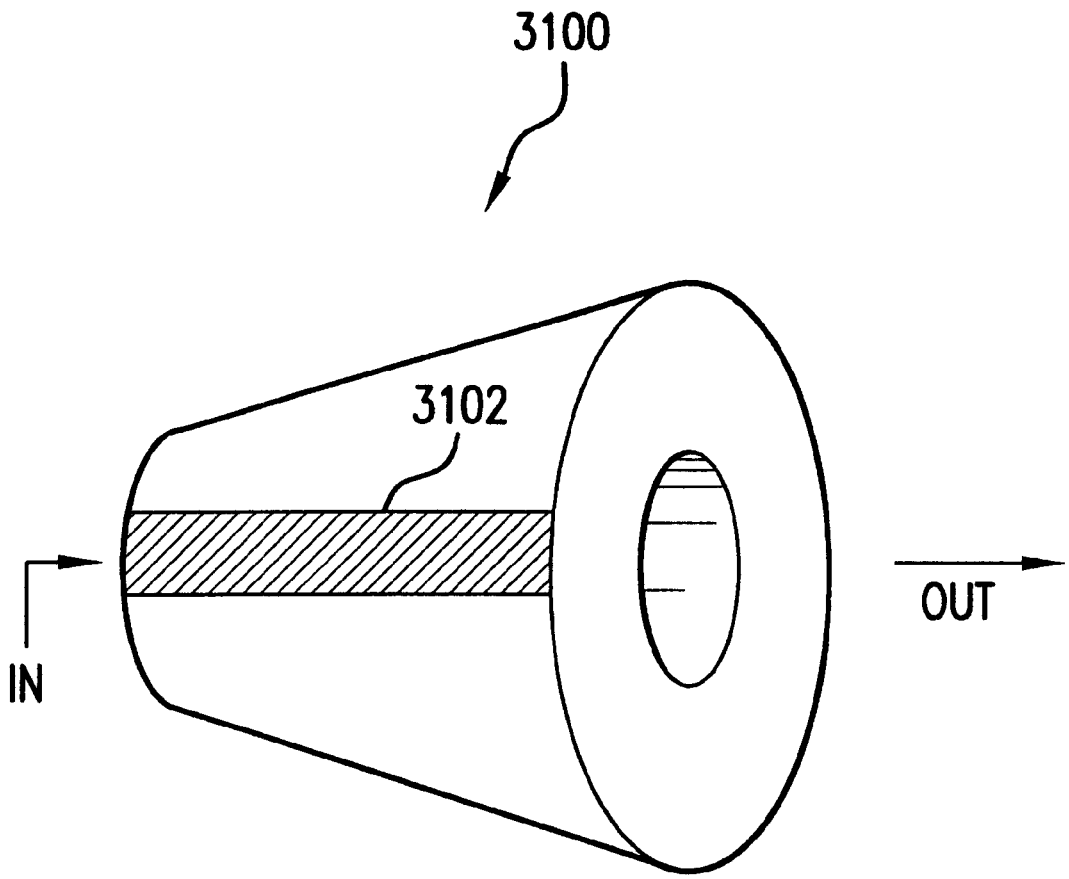
FIGS. 31–32 illustrate SCH antennas with an increasing impedance profile, according to embodiments of the invention.
Figure 32:
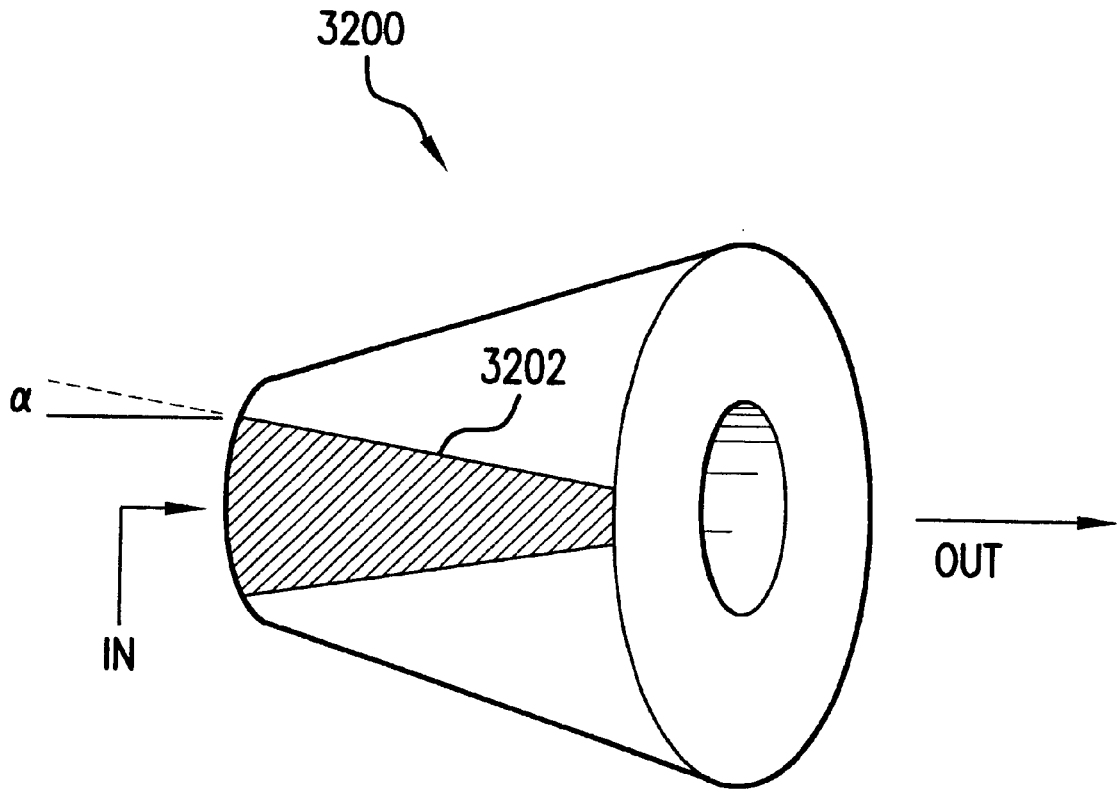

FIGS. 31 and 32 illustrate SCH antennas that each have an increasing impedance profile. In FIG. 31A, an SCH antenna 3100 has a conductor 3102 with a 0 degree flare angle, and therefore a constant conductor arc length (and constant sector angle $\phi$, along the length of the SCH antenna 3100. This results in an increasing impedance profile from the input to the output of the SCH antenna 3100, because the constant arc length does not compensate for the increasing thickness of the dielectric.

In FIG. 32, an SCH antenna 3200 has a conductor 3202 having a conductor arc length that decreases from the input to the output of the SCH antenna 3200. Therefore, the flare angle $\alpha$ is negative, and corresponding sector angle $\phi$ decreases from the input to the output of the SCH antenna 3200. This also produces an increasing impedance profile from an input to the output of the SCH antenna 3200.

Other flare angle configurations and impedance profiles will be apparent to those skilled in the arts based on the descriptions given herein. These other configurations are within the scope and spirit of the present invention.

3b. Dielectric Lens

Figure 29:
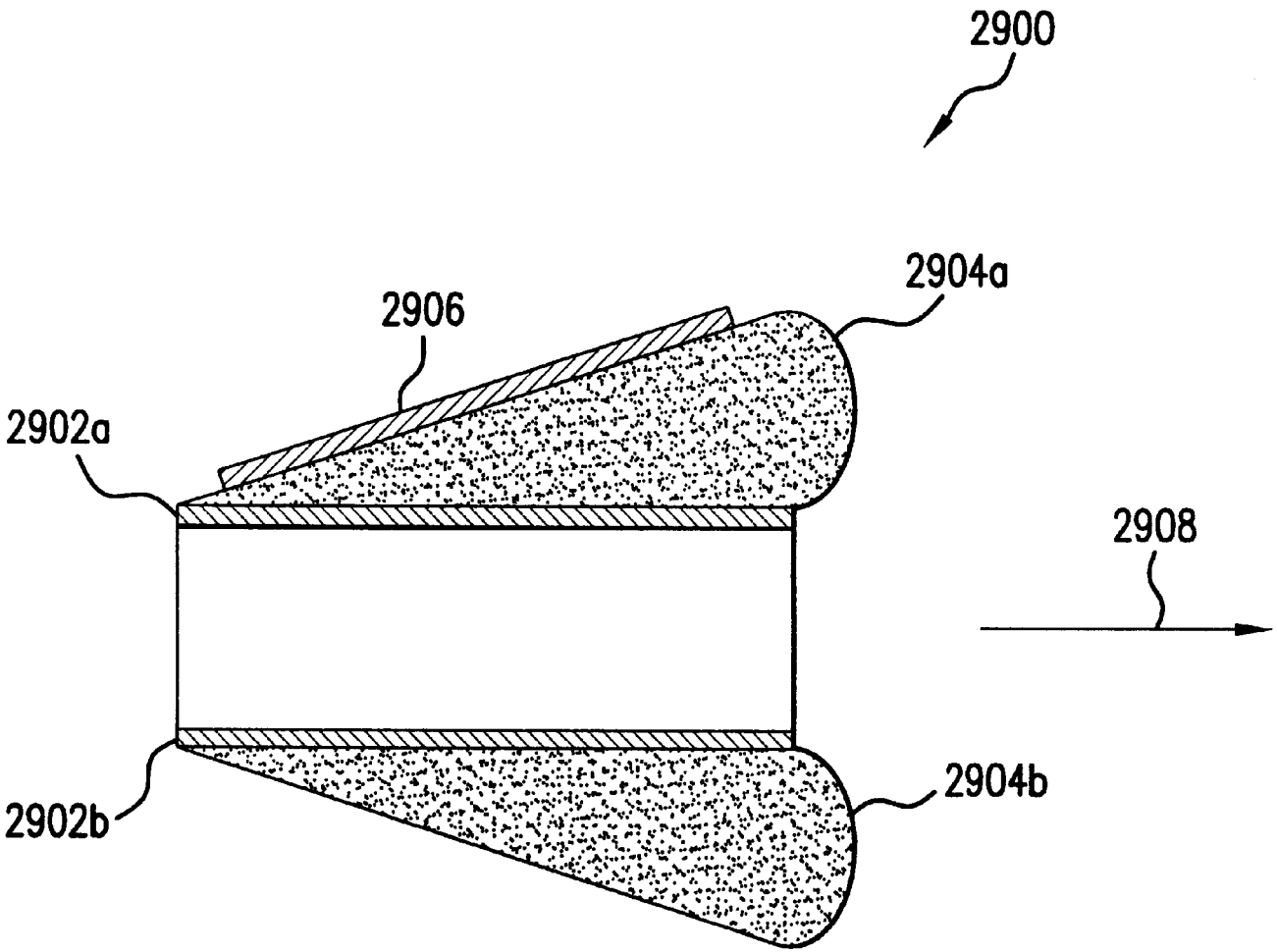
FIG. 29 illustrates a SCH antenna with an extended dielectric to form a dielectric lens on the output of the SCH antenna, according to embodiments of the present invention.

A dielectric lens can be effectively added to the output of a SCH antenna by extending the dielectric beyond the outer conductor. For example, FIG. 29 illustrates a cut view of a SCH antenna 2900, which includes an inner conductor 2902, a dielectric 2904, and an outer conductor 2906. The SCH antenna 2900 is similar to the SCH antenna 1100, except that the dielectric 2904 is extended beyond the outer conductor 2906 and the inner conductor 2902, in a donut or toroidal fashion as shown. As such, the dielectric 2904 operates as a dielectric lens that focuses an EM signal that is radiated from the antenna 2900 toward a center axis 2908, as shown.

4. Multi-Element Semi-Coaxial Horn Antenna

As shown in FIGS. 8 and 9, the object detector 801 utilizes separate antennas 808*a* and 808*b* for transmit and receive operations. This can be realized by adding a second outer conductor to the dielectric of a SCH antenna.

Figure 12A:
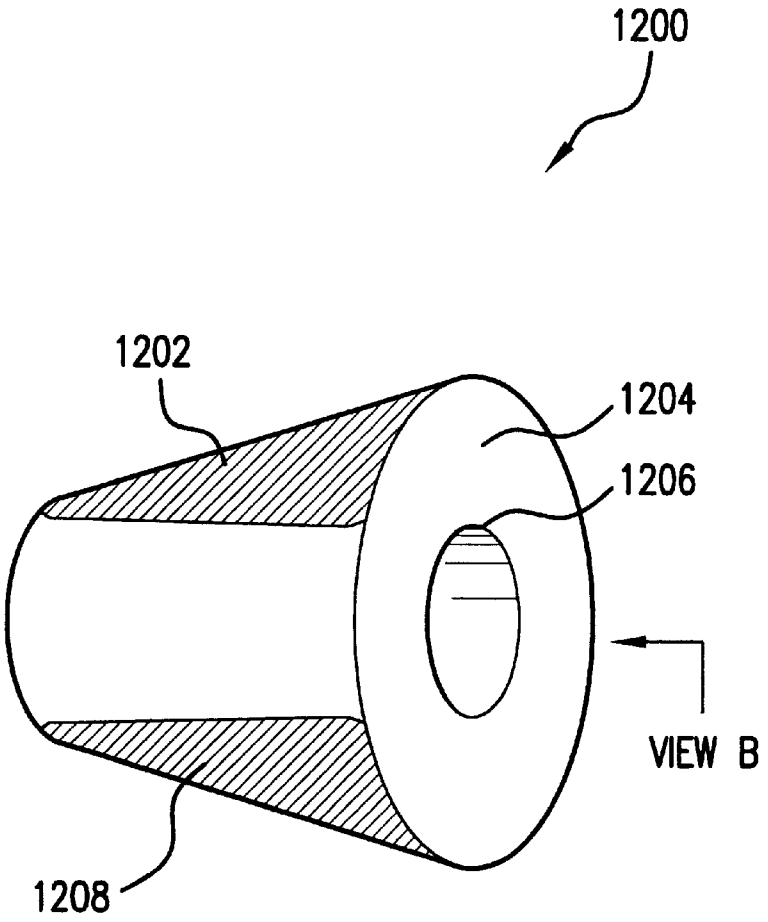
FIGS. 12A–B illustrate a SCH antenna 1200 with two radiating elements, according to embodiments of the present invention.

FIG. 12A illustrates a two element SCH antenna 1200 having a first outer conductor 1202, a dielectric 1204, an inner conductor 1206, and a second outer conductor 1208. The SCH antenna 1200 is substantially similar to the SCH antenna 1100 in FIG. 11, but includes the second outer conductor 1208. As such, the first outer conductor 1202 can be used for transmit operations and the second outer conductor 1208 can be used for receive operations, or vica versa.

Figure 12B:
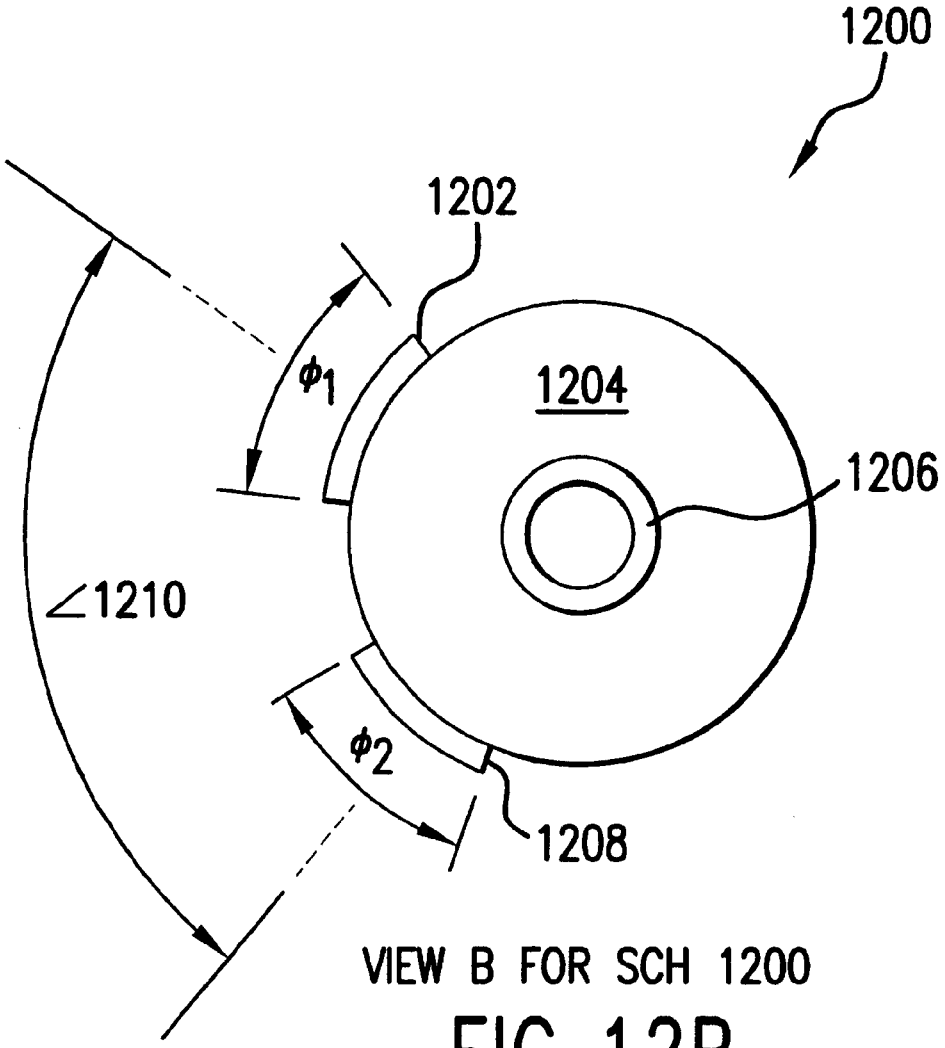

FIG. 12B illustrates an end view B of the SCH antenna 1200. FIG. 12B clearly shows the inner conductor 1206, and the dielectric 1204. FIG. 12B also shows the first outer conductor 1202 and the second outer conductor 1208. As in FIG. 11D, the thicknesses of the outer conductors 1202 and 1208 are exaggerated in FIG. 12B for ease of illustration.

The angle 1210 between the first outer conductor 1202 and the second outer conductor 1208 can be varied depending on the application. For example, the angle 1210 can be 90 degrees for orthogonal polarization between the first and second conductors. For co-polarization between the first and second conductors, the angle 1210 can be 180 degrees. In embodiments, an angle 1210 of 120 degrees is preferable for sensing studs in a wall.

Additionally, the outer conductors 1202 and 1208 have corresponding sector angles $\phi_1$ and $\phi_2$, respectively. The sector angles $\phi_1$ and $\phi_2$ can be the same or can be different, depending on the application.

The invention is not limited to two outer conductors. Any number of outer conductors could be utilized, assuming consideration is made for cross coupling and impedance match.

5. Conformal Mapping and Impedance Determination

Although a good impedance along the SCH antenna may be obtained by trial and error, it is beneficial to have a theoretical prediction to serve as a starting point. A technique called "conformal mapping" was used to convert the SCH antenna cross-section to a standard co-planar stripline with unequal linewidths. This section will discuss how conformal mapping works, provide a few simple examples by way of illustration, and discuss the two different conformal mappings used. These conformal mappings lead to formulas for the impedance of a SCH cross-section that may be used to size the width or sector angle $\phi$ of the conducting elements.

A conformal map is a tool used in complex analysis to transform one geometry to another. Conformal maps have the property that they preserve angles. Therefore, two lines that intersect with a particular angle in one geometry will intersect with that exact same angle in the new geometry that results from the conformal mapping. One side effect of this property is that a solution of Laplace's equation ($V^2\phi=0$) will still be a solution under transformation by a conformal mapping. Further, the characteristic impedance of a transmission line cross-section is also preserved under a conformal mapping.

By applying conformal mapping to stripline, the relatively simple stripline geometry with known impedance characteristics, can be transformed into a more exotic geometry. Two excellent references which discuss this procedure are: *Field Theory of Guided Waves*, Robert Collins, (New York: McGraw Hill, 1960), herein incorporated by reference in its entirety; and *Static and Dynamic Electricity*, William R. Smythe, (New York: McGraw Hill, 1968), herein incorporated by reference in its entirety. For a desired impedance, this will allow determination of the correct dimensions of a transmission line, horn or SCH antenna whose cross-section has this exotic geometry.

5a. Example: Relating a Coaxial Line to a Parallel Strip Line

Figure 13:
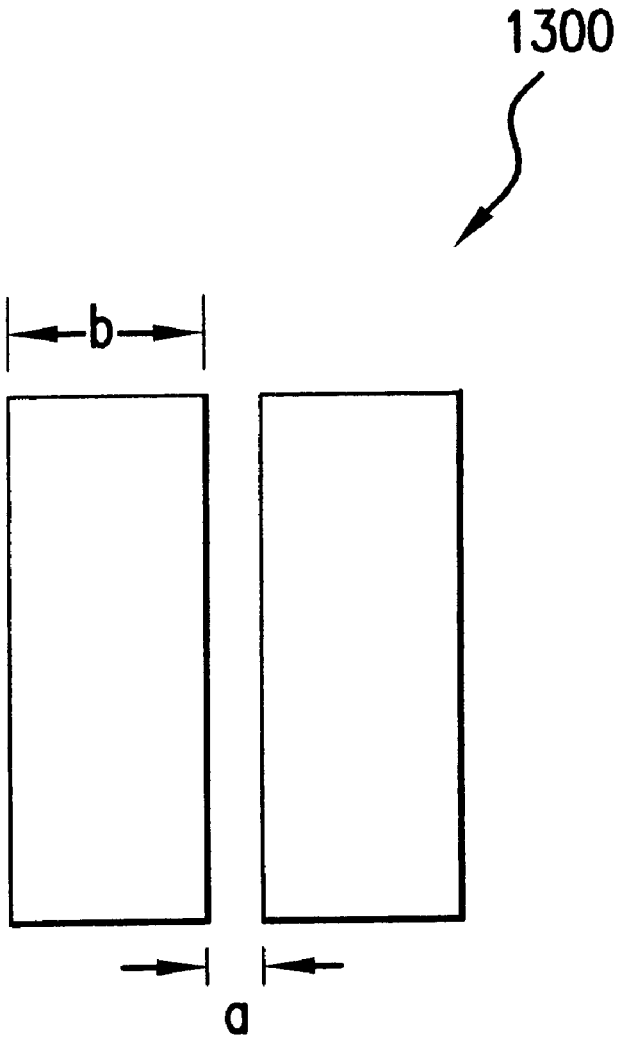
FIG. 13 illustrates a stripline 1300.

For example, consider a parallel strip line 1300 in FIG. 13 having of width b separated by a spacing a. If b>>a, the characteristic impedance of such a line is:

$$Z = \frac{Z_0}{\sqrt{\varepsilon_r}}\frac{a}{b} \tag{1}$$

where $Z_0$ is the characteristic impedance of free space, and $\epsilon_r$ is the relative dielectric constant of the medium between the strips. For the particular case of an air gap strip line in which a=0.5 and b=2$\pi$, the characteristic impedance is:

$$Z = Z_0\frac{a}{b} = 376.6\Omega\left(\frac{1}{4\pi}\right) = 30.0\Omega.$$

Figure 14:
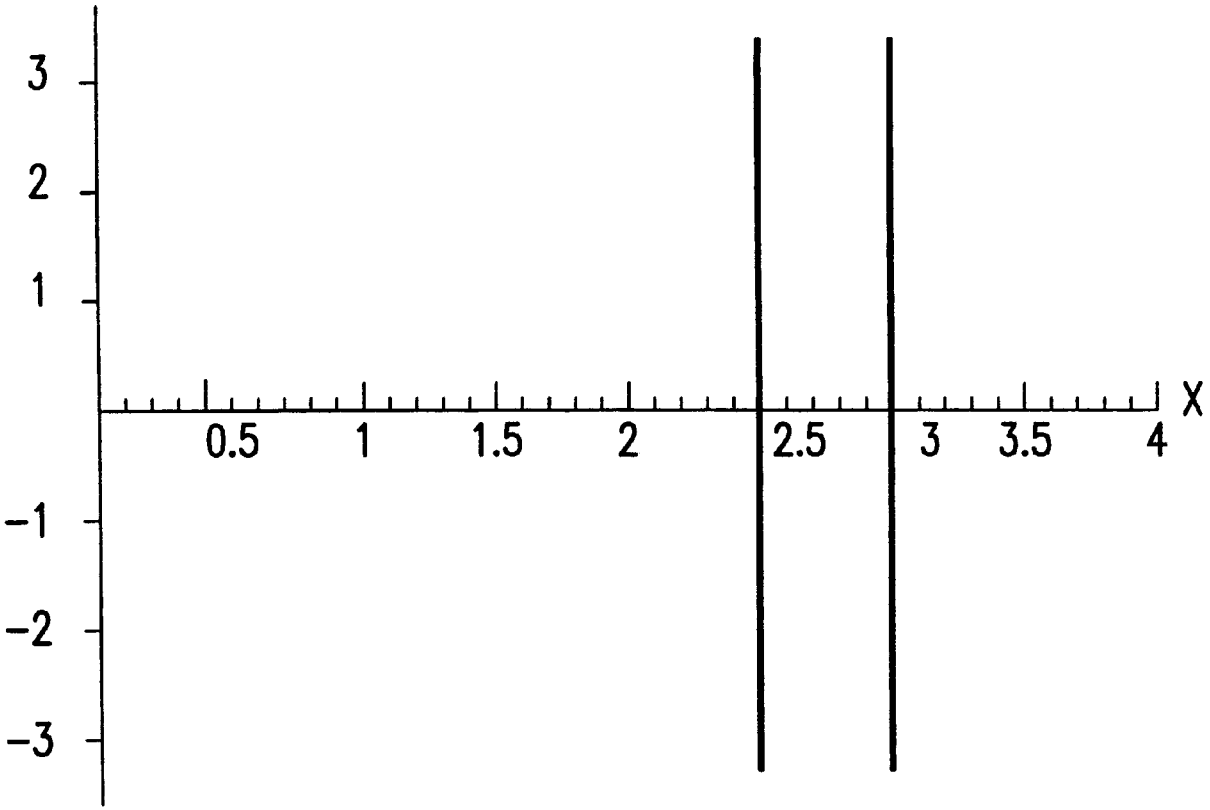
FIG. 14 illustrates a stripline in complex space.

This strip line is displayed in the complex z plane in FIG. 14.

Now consider the conformal mapping:

$$w=e^z \tag{2}$$

which maps points z=x+jy in the complex z plane to points w=u+jv in the complex w plane. Under this mapping, our strip line becomes the coaxial line shown in FIG. 15.

Figure 15:
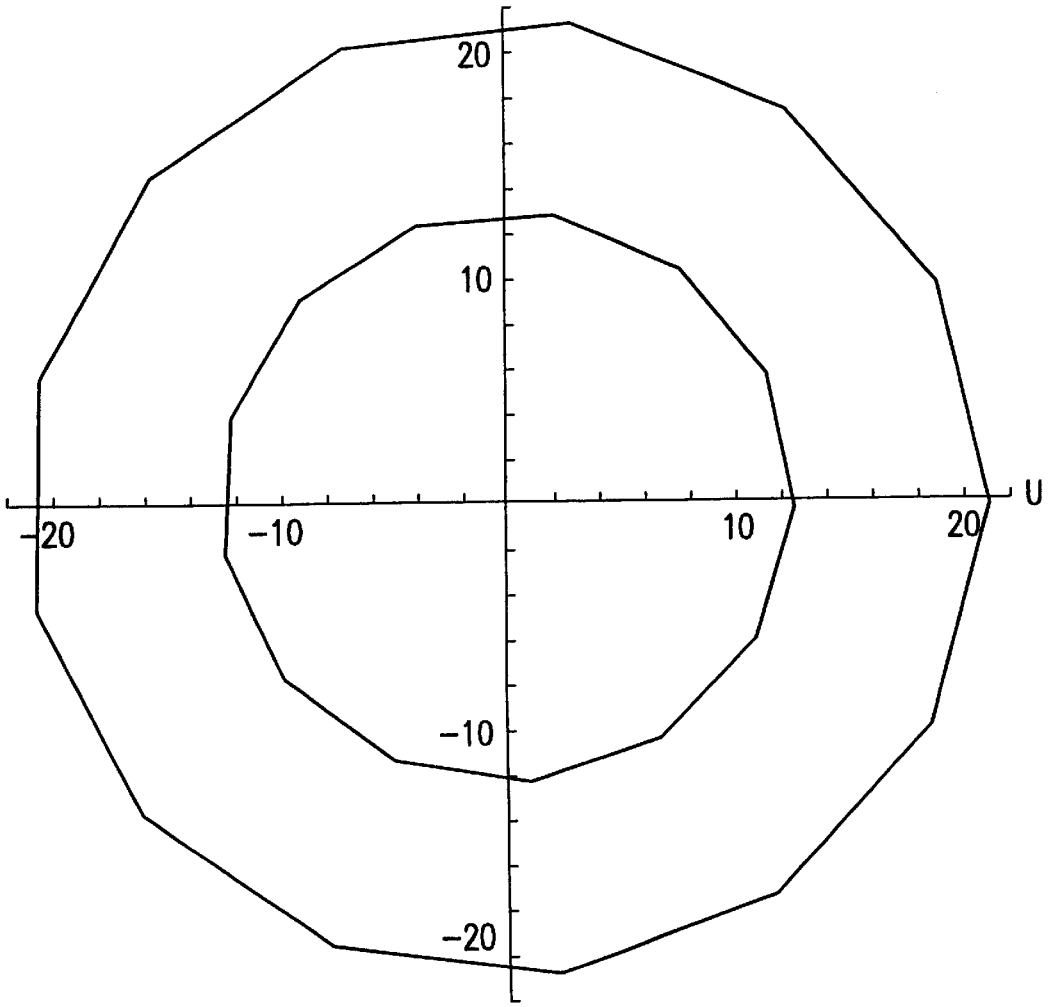
FIG. 15 illustrates an airgap coaxial line in complex space.

The characteristic impedance of a coaxial line as shown in FIG. 15 is:

$$Z = \frac{Z_0}{2\pi\sqrt{\varepsilon_r}} \ln\left(\frac{r_o}{r_i}\right) \tag{3}$$

where $r_o$ and $r_i$ are the outer and inner radii, respectively. The conformal mapping converts the strip line into a coaxial line with $r_o=e^3=20.0$ and $r_i=12.11825$. The corresponding characteristic impedance is:

$$Z = \frac{376.6\Omega}{2\pi} \ln\left(\frac{20.1}{12.2}\right) = 30.0\Omega$$

Note that the conformal mapping preserves the characteristic impedance of the transmission line.

5b. Impedance of the Semi-Conical Horn

Figure 16:
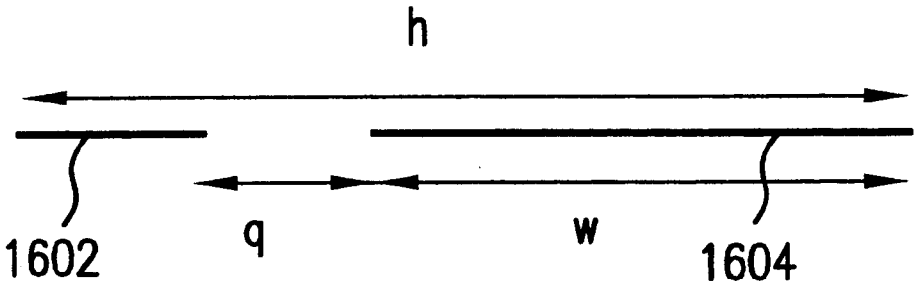
FIG. 16 illustrates unequal co-planar lines.

The conformal mapping technique used is section 5*a* can also be applied to determine the impedance of the semi-coaxial horn antenna. As a starting point, consider a transmission line consisting of two unequal co-planar strip lines 1602 and 1604 as shown in FIG. 16. The unequal co-planer lines have parameters h, q, and w as defined in FIG. 16. The characteristic impedance of this strip line is given by Smythe, but is modified by a factor of 2 to account for SCH half-plane coupling:

$$Z = \frac{Z_0}{\sqrt{\varepsilon_r}} \frac{K(k)}{K(\sqrt{1-k^2})} \tag{4}$$

where:

$$k^2 = \frac{hq}{(w+q)(h-w)} \tag{5}$$

and K(k) is the complete elliptic integral of the first kind:

$$K(k) = \int_0^{\frac{\pi}{2}} \frac{1}{\sqrt{1-k\sin^2\theta}}\, d\theta = \int_0^1 \frac{1}{\sqrt{(1-t^2)(1-kt^2)}}\, dt. \tag{6}$$

Figure 17:
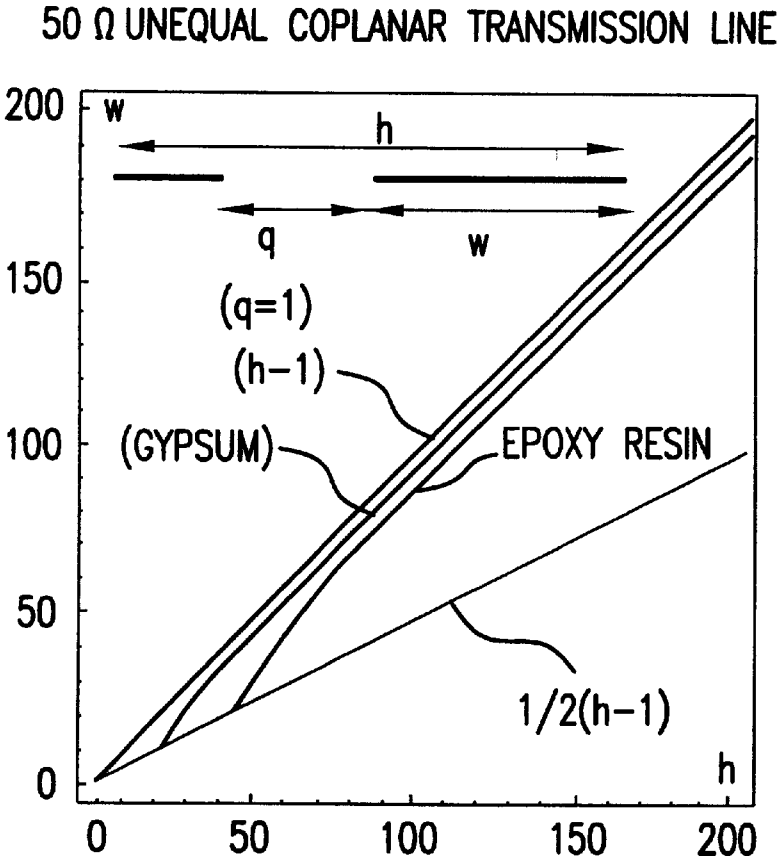
FIG. 17 illustrates 50 ohm unequal co-planar transmission line.
Figure 18:
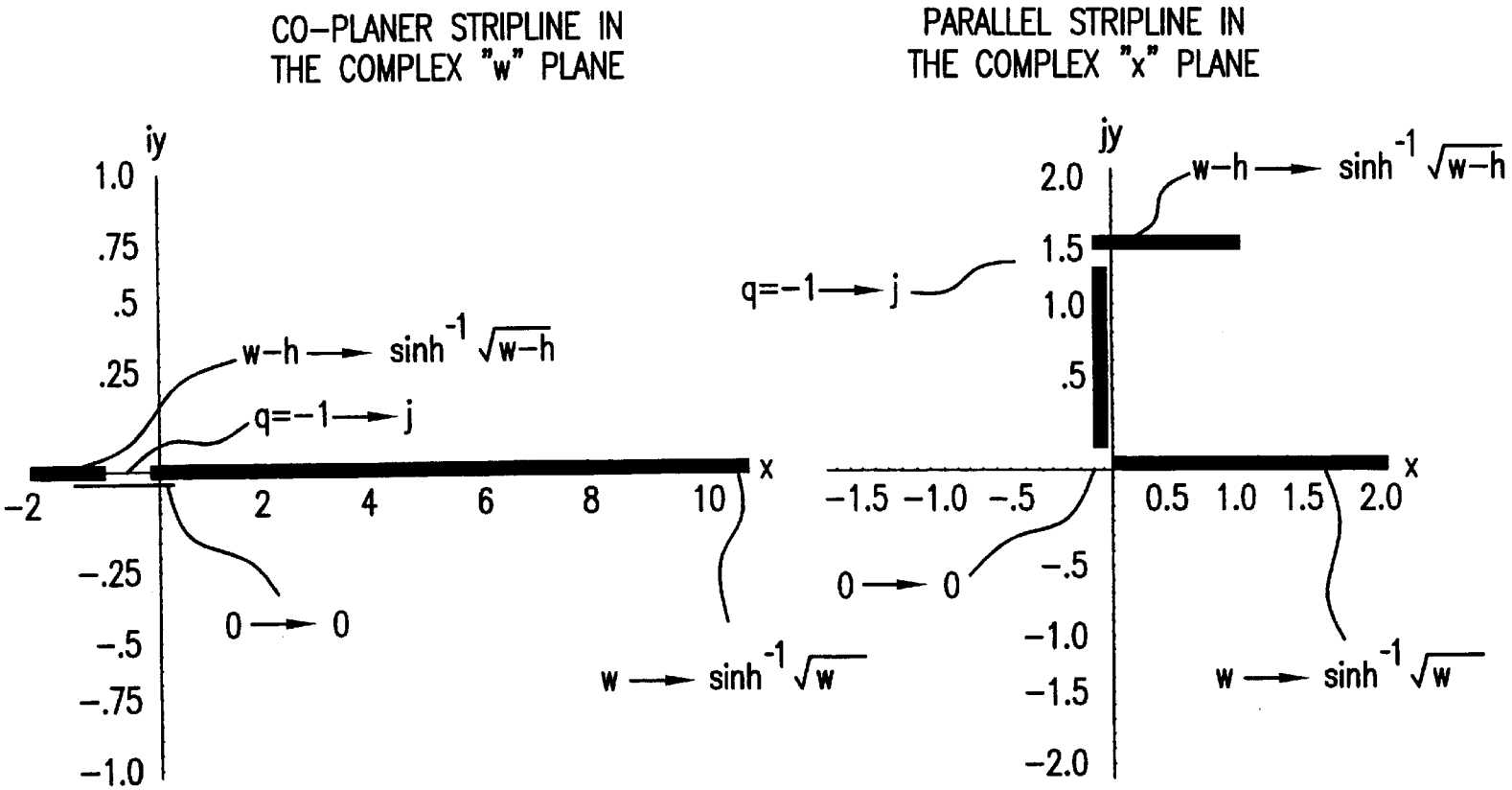
FIG. 18 illustrates conformal mapping from co-planer to parallel lines.

The unequal co-planer line parameters can be determined for a desired impedance by numerically solving equations (4)–(6) simultaneously. For example, FIG. 17 illustrates the co-planer line parameters to yield a 50 Ω transmission line, assuming a gypsum ($\epsilon_r$=5.5) and epoxy resin ($\epsilon_r$=4.7) dielectric. A co-planar stripline to parallel stripline transformation is shown in FIG. 18.

A semi-coaxial horn defined by coordinates in complex z-space (x+jy) can be mapped into complex w-space (u+jv) to create unequal co-planar lines using the following transformation:

$$w = \cos\left[\frac{\pi}{\ln r_o - \ln r_i}(\ln z - \ln r_i + j\pi)\right]. \tag{7}$$

where, the parameters that describe the cross-section of a SCH antenna are illustrated in FIG. 19. A detailed step-by-step description of the conformal mapping is provided in FIGS. 20A–20D. In other words, the FIGS. 20A–20D illustrate the transformation of complex z-space to complex w-space, and thereby the transformation of a SCH antenna geometry to an unequal co-planer line geometry. Once the transformation is complete, the impedance of the unequal co-planer lines can be easily calculated according to equations (4)–(6) above. FIGS. 20A–20D are discussed in detail as follows.

Figure 20C:
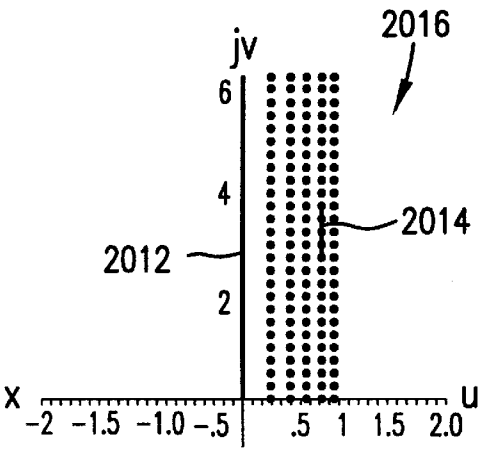
FIGS. 20A–D illustrate conformal mapping to transform a SCH geometry to co-planer lines with unequal line widths, according to embodiments of the invention.
Figure 20B:
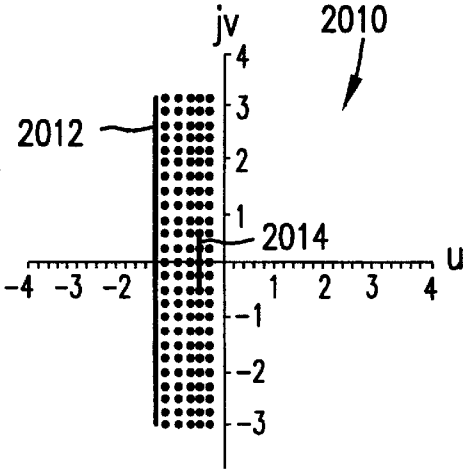
Figure 20D:
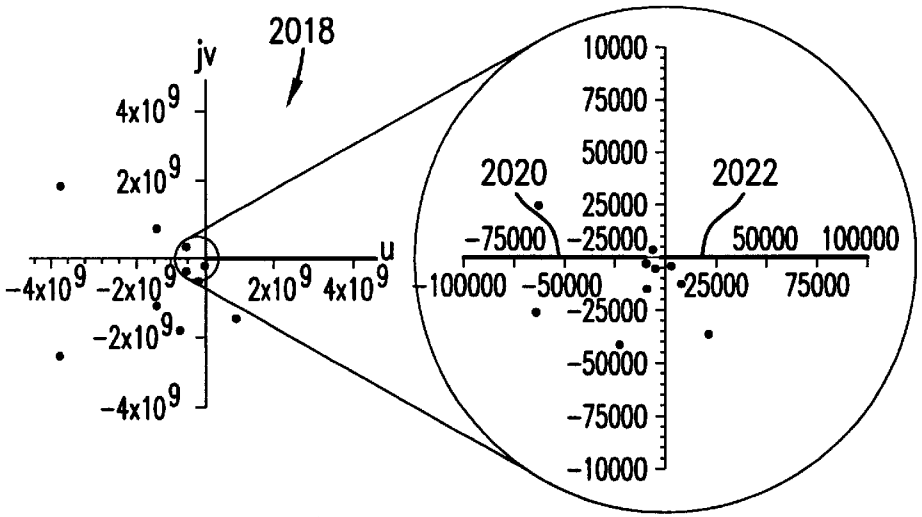
Figure 20A:
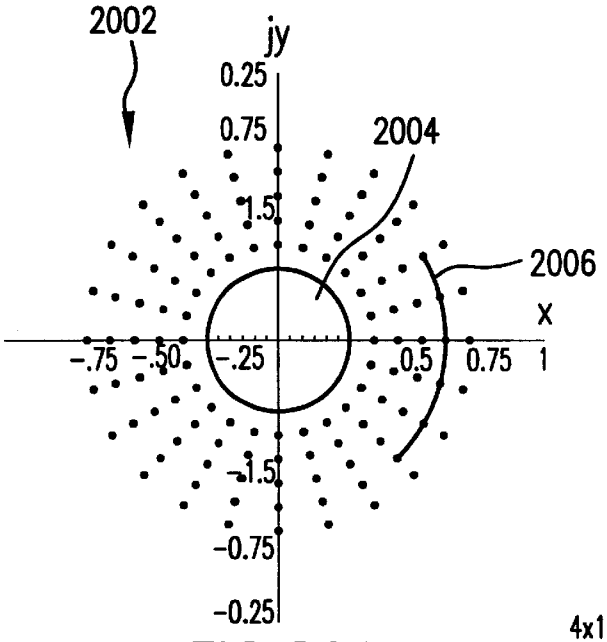

FIG. 20A illustrates complex z-space 2002 having an inner conductor 2004 and an outer conductor 2006 that define the cross-section of a SCH antenna. Complex z-space 2002 coordinates can be converted to complex w-space coordinates by the following transformation equation:

$$w=\ln(z). \tag{8}$$

FIG. 20B illustrates complex w-space 2010 produced by transforming the coordinates in the complex z-space 2002 using Equation 8. In doing so, the inner conductor 2004 and outer conductor 2006 are transformed into lines 2012 and 2014, respectively.

FIG. 20C illustrates the translation of the coordinates in w-space 2010 to produce w-space 2016 using the translation:

$$w=\ln z-\ln z-\ln r_i+j\pi. \tag{9}$$

The effect of the translation using equation 9 is to move the planer lines 2012 and 2014 to the origin of w-space 2016, as shown.

FIG. 20D illustrates the final translation of w-space 2016 to w-space 2018 using equation 7. More specifically, the coordinates in w-space 2016 are multiplied by a scaling factor $\pi/(\ln r_o-\ln r_i)$, the result of which is the argument of a cosine function as seen in FIG. 7. As a result, lines 2012, 2014 are translated to the unequal co-planer lines 2020 and 2022, respectively.

The impedance of the unequal co-planer lines 2020, 2022 can be readily calculated using the equations (4)–(6) above. Because of the transformation, the impedance of the unequal co-planer lines 2020, 2022 is also the impedance of the SCH antenna defined by the conductors 2004 and 2006 in FIG. 20A.

5c. Geometry of the SCH cross-section

By using the conformal mapping transformation, the parameters for co-planar unequal stripline can be described in terms of the SCH antenna geometry according to the following equations:

$$q = \mathrm{Re}\left[-\cos\frac{\pi(-j\pi + \ln r_i - \ln[-e^{-j\phi}r_o])}{\ln r_i - \ln r_o}\right] \tag{10}$$

$$w = \mathrm{Re}\left[\cos\frac{\pi(j\pi + \ln[-r_i] - \ln r_i)}{\ln r_o - \ln r_i}\right] \tag{11}$$

$$w - h = \mathrm{Re}\left[\cos\frac{\pi(j\pi - \ln r_i + \ln[-r_o])}{\ln r_o - \ln r_i}\right]; \tag{12}$$

where $r_i$ is the radius of the inner SCH conductor;

$r_o$ is the radius of the outer SCH conductor;

$\phi$ is the sector angle associated with the outer SCH conductor; and where the unequal co-planer parameters q, w, and (w–h) are defined in FIGS. 16–18.

Equations (4)–(6) and (10)–(12) can be implemented in a Mathematica code to calculate the impedance of a SCH antenna cross-section for specific SCH parameter values (i.e. $r_i$, $r_o$, and $\phi$).

Figure 21:
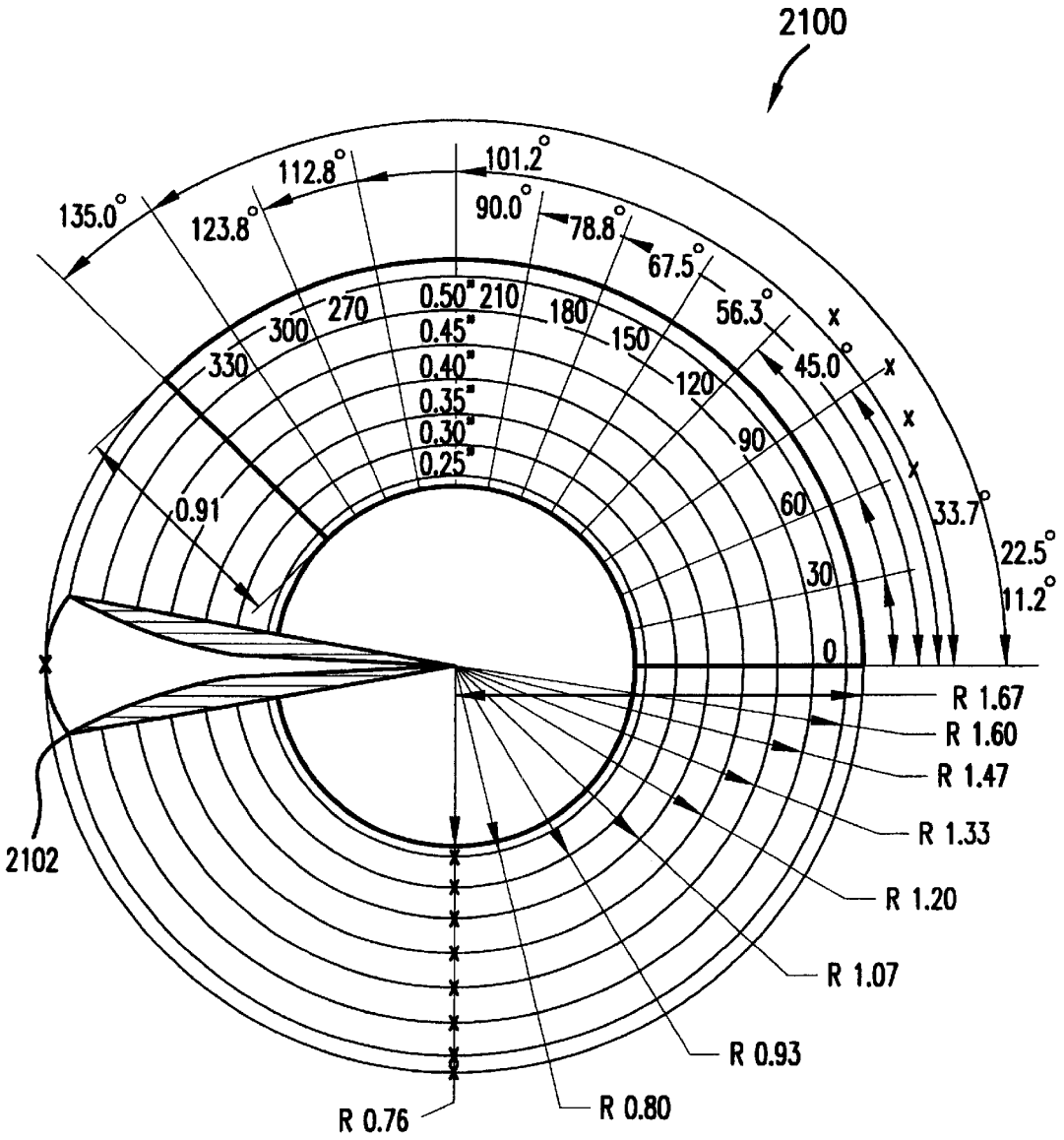
FIG. 21 illustrates a template for a SCH antenna, according to embodiments of the invention.

FIG. 21 illustrates a template 2100 for an approximately 1" SCH antenna. The template 2100 includes an outer conductor 2102, which can be sized using the impedance calculations described herein.

Two SCH antennas were constructed using the template in FIG. 21. The SCH antennas were based around an epoxy dielectric core having $\epsilon_r$=4.7, and a gypsum ($CaSO_4.2H_2O$) dielectric core that was formed from plaster of Paris. The gypsum antenna provides a good impedance match to gypsum drywall, $\epsilon_r$=5.5. In embodiments, a more suitable manufacturable material with similar dielectric constants could replace either the epoxy resin or the gypsum.

6. Connector Attachments

FIGS. 22–25 illustrate various connector attachments for SCH antennas, which are described as follows.

Figure 22:
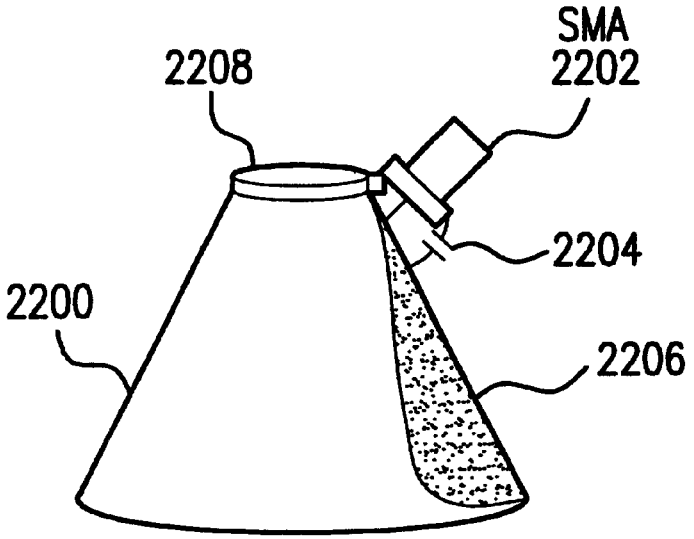
FIG. 22 illustrates a SMA connector with optional matching capacitor for connecting to a SCH antenna, according to embodiments of the invention.

FIG. 22 illustrates an SMA connector 2202 that is connected to a SCH antenna 2200, which has an inner conductor 2208 and an outer conductor 2206. The center pin of the SMA connector 2202 is connected to the outer conductor 2206, and the outer shell of the SMA connector 2202 is connected to the inner conductor 2208 as shown. Various materials can be utilized to provide a suitable electrical connection including but not limited to: solder, conductive epoxy, and mechanical contact.

The SMA connector configuration illustrated in FIG. 22 provided an acceptable match to 50 Ω. More specifically, a VSWR of 3.5–2.5:1 was obtained using the SMA connector configuration. An optional capacitor 2204 can be added to provide a parallel matching network as shown, which improves the VSWR significantly over a particular bandwidth. In embodiments, the capacitor 2204 is a 1 pF capacitor. However, other capacitor values could be utilized as will be understood by those skilled in the relevant arts.

Figure 23:
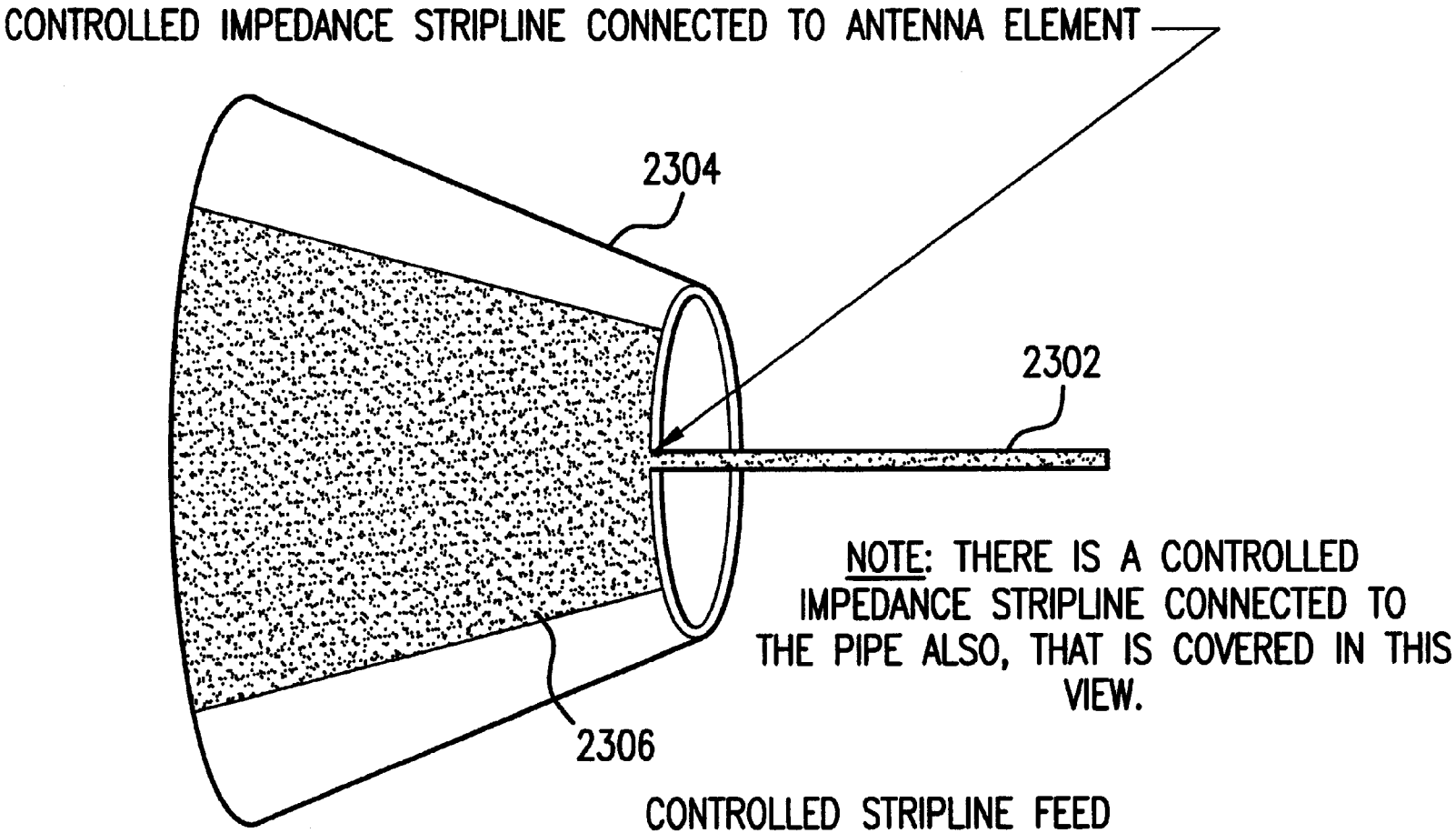
FIG. 23 illustrates a controlled stripline feed for a SCH antenna, according to embodiments of the invention.

FIG. 23 illustrates a stripline 2302 connected to a SCH antenna 2304. The stripline 2302 is connected to an outer conductor 2306. A second stripline is connected to an inner conductor of the antenna 2304, but is not shown for ease of illustration.

Figure 24:
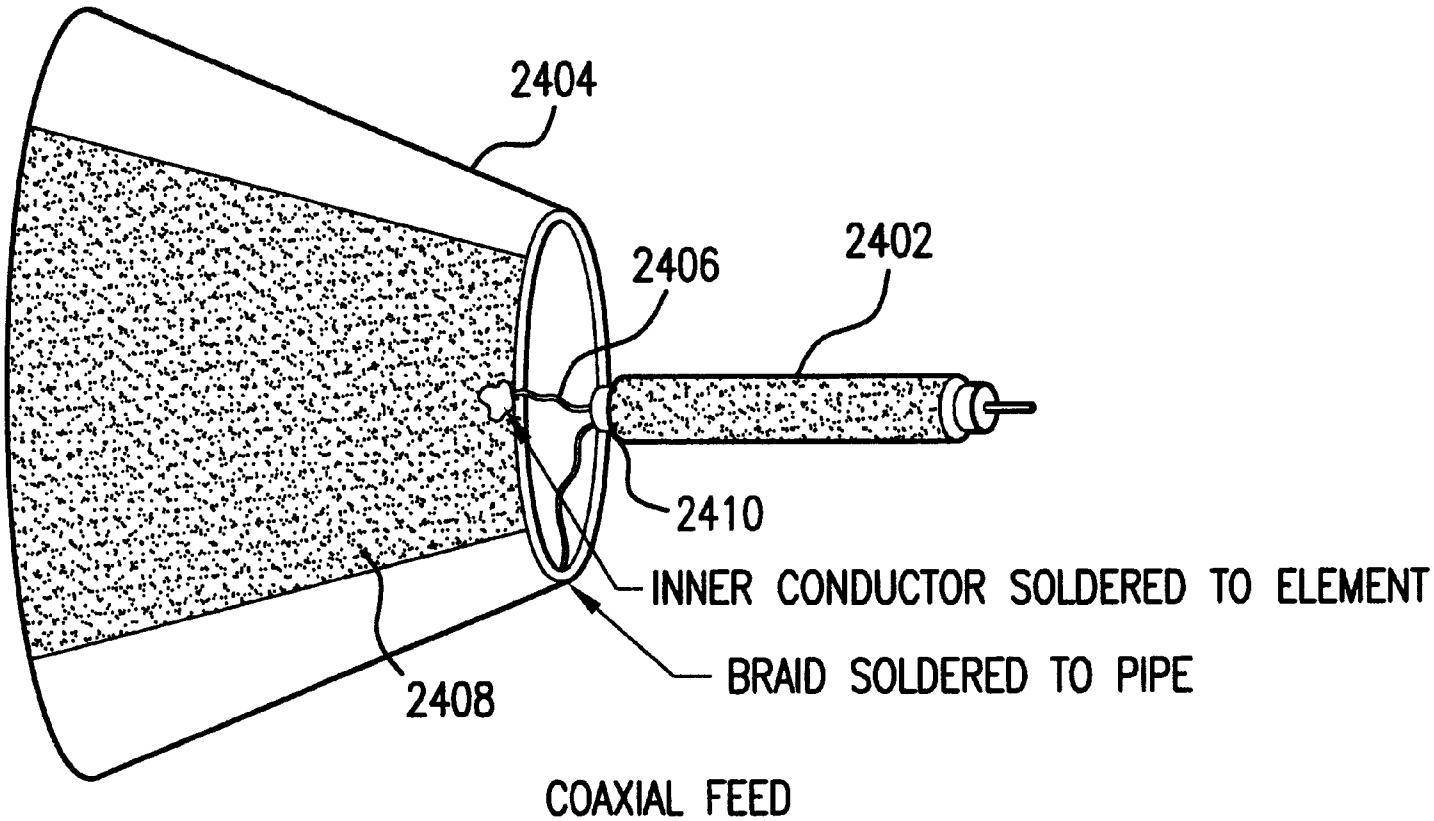
FIG. 24 illustrates a coaxial feed for a SCH antenna, according to embodiments of the invention.

FIG. 24 illustrates a coax 2402 connected to a SCH antenna 2404. An inner conductor 2406 of the coax 2402 is soldered to an outer conductor 2408 of the antenna 2404. An outer conductor 2410 of the coax 2402 is braid soldered to an inner conductor of the SCH antenna 2404.

Figure 25:
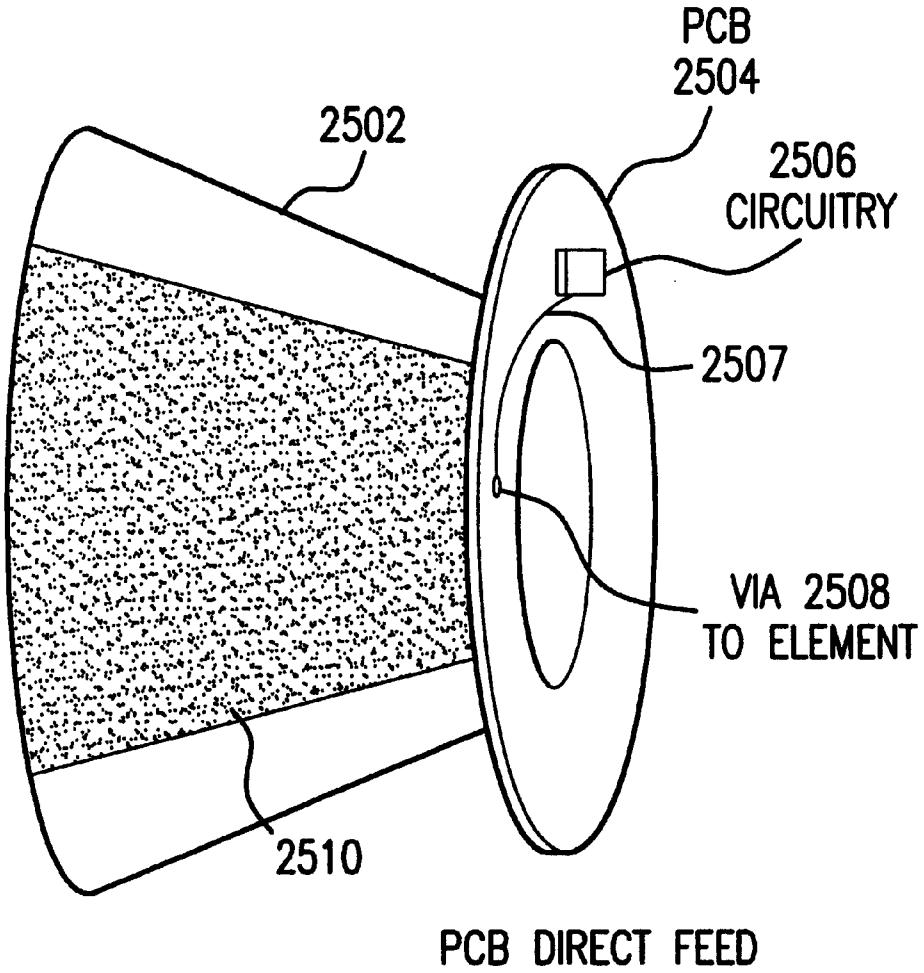
FIG. 25 illustrates a PCB feed for a SCH antenna, according to embodiments of the invention.

FIG. 25 illustrates a printed circuit board (PCB) direct feed to a SCH antenna 2502. More specifically, FIG. 25 illustrates a PCB board 2504 that is attached to the SCH antenna 2502. The PCB 2504 includes circuitry 2506 that drives the antenna 2502, and is connected to an outer element 2510 by the feed line 2507 and the via 2508. The backplane of the PCB 2504 is connected to an inner conductor of the SCH antenna 2502, but this connection is not shown for ease of illustration.

The connector configurations described herein are meant for example purposes only, and are not meant to be limiting. Other connector configurations will be realized by those skilled in the arts based on the discussion given herein. These other connector configurations are within the scope and spirit of the present invention.

7. SCH antenna performance

Figure 26:
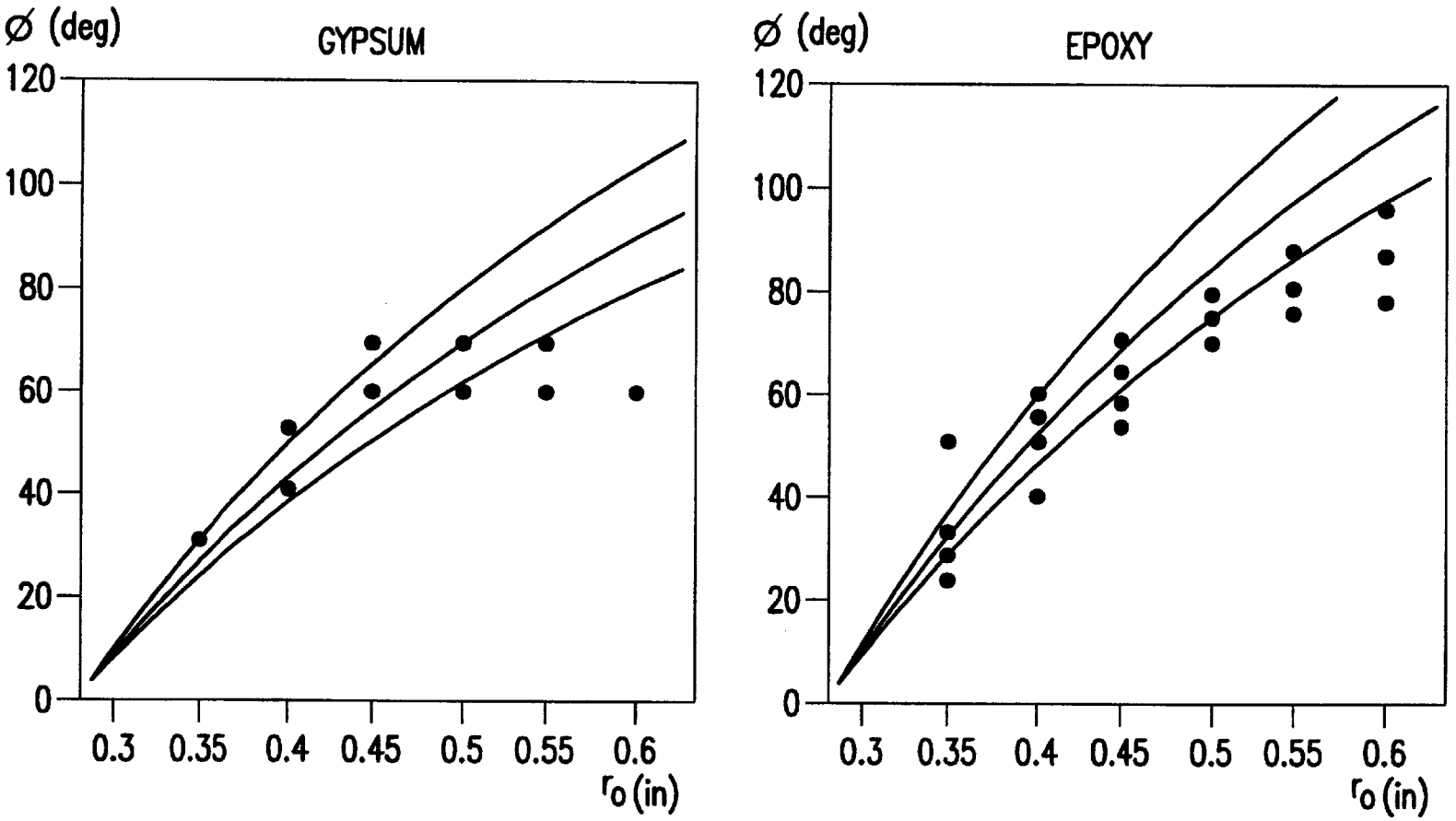
FIG. 26 illustrates an impedance match for SCH antennas that are made of gypsum and epoxy dielectrics.

FIG. 26 illustrates the match to 50 ohms for SCH antennas having gypsum and epoxy dielectrics. The middle line shows the predicted matched and the upper and lower lines show 10% variation from the predicted (i.e. +/−5 ohm limits) match.

Figure 27:
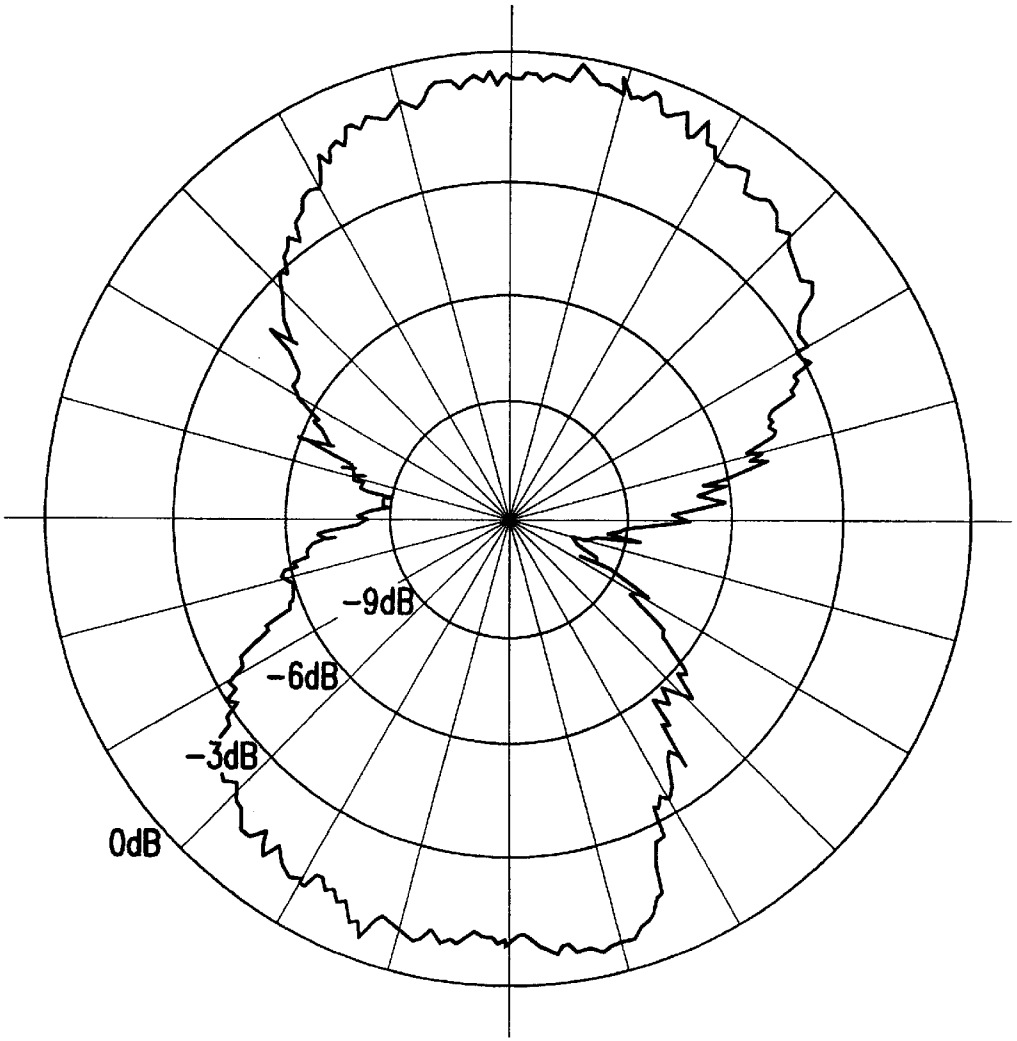
FIG. 27 illustrates a radiation pattern for a SCH antenna.

FIG. 27 illustrates a radiation pattern for a SCH antenna.

Figure 28A:
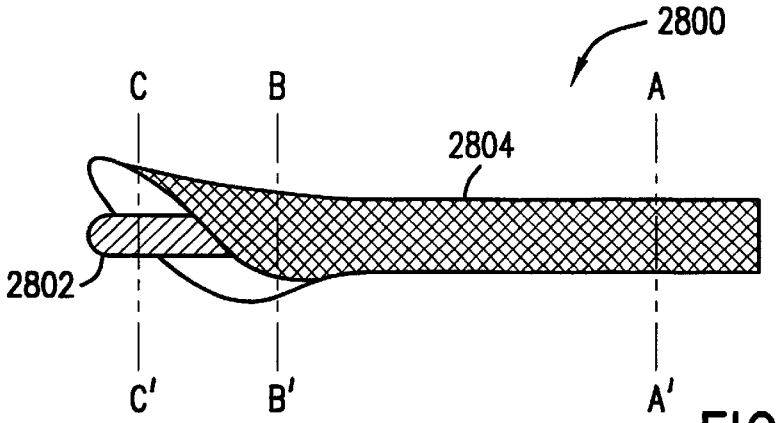
FIGS. 28A–D illustrate a SCH antenna, where the inner conductor is the radiating conductor and the outer conductor provides a ground, according to embodiments of the present invention.

8. Alternative Embodiment(s):

FIGS. 28A–D illustrate an alternative embodiment for a semi-coaxial horn antenna. FIG. 28A illustrates semi-coaxial horn 2800 having an inner conductor 2802 and an outer sheath 2804. The inner conductor 2802 is the radiating conductor, and can be coupled directly to the inner conductor of a coaxial line, or other connector. The outer sheath 2804 provides a ground and back plane for the inner conductor 2802, and can be seamlessly coupled to the outer conductor of a coaxial line or other connector. As such, the semi-coaxial horn 2800 provides a smooth transition from a coaxial line, or a connector that is attached to the semi-coaxial horn.

Figure 28B:
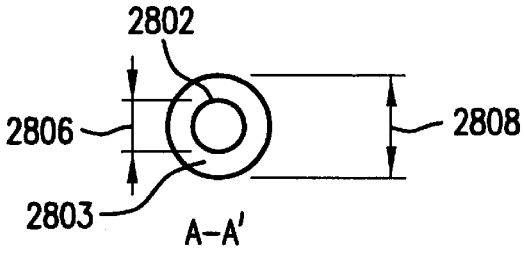
Figure 28C:
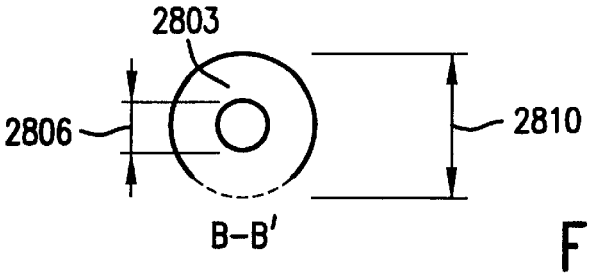
Figure 28D:
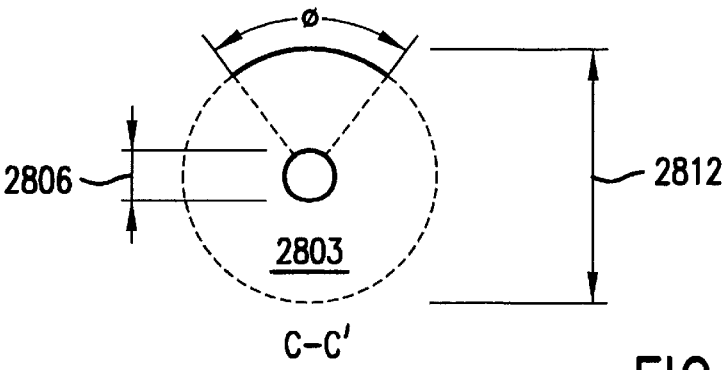

FIGS. 28B–D illustrate crossectional views A–A', B–B', and C–C', respectively of the antenna 2800. These cross-sections reveal that the inner conductor 2802 has a substantially constant diameter 2806. However, a variable diameter could be used. The diameter of the outer sheath 2804 expands from a diameter 2808 at cross-section A–A' to a diameter 2812 at the cross-section C–C'. Additionally, the outer sheath 2804 sweeps out a sector angle $\phi$ that varies from a maximum 360 degrees at the cross-section A–A' to a minimum at the cross-section C–C', as shown. Additionally, the space 2803 between the inner and outer conductors can be filled with various dielectrics based on the specific application. Some exemplary dielectrics include: air, gypsum, epoxy resin, and other useful dielectrics. The impedance along the antenna 2800 is based on the relative conductor diameters, sector angle $\phi$, and dielectric, and is determined in a manner similar to that described for the semi-coaxial horn 1100 in FIGS. 11A–D.

The semi-coaxial horn antennas described herein are provided for example purposes only, and are not meant to be limiting. Other embodiments and implementations will be apparent to those skilled in the arts based on the discussion given herein. These other embodiments and implementations are within the scope and spirit of the present invention.

9. Conclusion

Example embodiments of the methods, systems, and components of the present invention have been described herein. As noted elsewhere, these example embodiments have been described for illustrative purposes only, and are not limiting. Other embodiments are possible and are covered by the invention. Such other embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed is:

1. An antenna, comprising:

an inner conductor having a substantially circular cross-section with a radius $r_i$ about an axis of the antenna that is perpendicular to a plane of said cross-section; and an outer conductor having a cross-section that is substantially a circular arc about said axis, said arc covering a sector angle $\phi$ and having a radius $r_o$ that is greater than said radius $r_i$, wherein said sector angle $\phi$ varies in a continuous fashion along said axis from a minimum at an input of said antenna to a maximum at an output of said antenna.

2. The antenna of claim 1, wherein said inner conductor is hollow.

3. The antenna of claim 1, wherein said inner conductor is solid.

4. The antenna of claim 1, wherein said continuously variable sector angle $\phi$ provides a desired impedance profile along said axis such that said input of said antenna is matched to an external impedance connected to said input.

5. The antenna of claim 4, wherein said impedance profile is substantially constant along a length of said antenna.

6. The antenna of claim 1, further comprising a dielectric between said inner conductor and said outer conductor.

7. The antenna of claim 6, wherein a dielectric constant of said dielectric substantially matches a dielectric constant of a target medium, wherein said antenna launches an electromagnetic (EM) signal into said target medium.

8. The antenna of claim 7, wherein said EM signal is an impulse radio signal.

9. The antenna of claim 6, wherein said dielectric has an inner surface and an outer surface, said dielectric inner surface coupled to an outer surface of said inner conductor, and said dielectric outer surface coupled to an inner surface of said outer conductor.

10. The antenna of claim 9, wherein said outer surface of said dielectric has a substantially cone-like shape along said axis of said antenna.

11. The antenna of claim 6, wherein said dielectric is air.

12. The antenna of claim 6, wherein said dielectric is epoxy resin.

13. The antenna of claim 6, wherein said dielectric is gypsum.

14. The antenna of claim 6, wherein said dielectric extends beyond said outer conductor, thereby resulting in a dielectric lens on an output of said antenna.

15. The antenna of claim 1, wherein said outer conductor is a radiating conductor, and said inner conductor is a ground.

16. The antenna of claim 15, further comprising a second outer conductor having a substantially circular arc cross-section about said axis, said second outer conductor arc having said radius $r_o$, and having a sector angle $\phi_2$.

17. The antenna of claim 16, wherein said second sector angle $\phi_2$ is substantially equal to said sector angle $\phi$ of said outer conductor along a length of said axis of said antenna.

18. The antenna of claim 16, wherein said outer conductor transmits an EM signal, and wherein said second outer conductor receives a reflected version of said transmitted EM signal.

19. The antenna of claim 16, wherein said second outer conductor is rotated around said axis by a rotation angle relative to said outer conductor.

20. The antenna of claim 16, wherein said rotation angle is approximately 120 degrees.

21. The antenna of claim 1, further comprising a means for connecting an EM signal to one of said inner conductor and said outer conductor.

22. The antenna of claim 1, wherein an impedance of said antenna is determined according to the following system of equations, comprising:

$$Z = \frac{Z_0}{\sqrt{\varepsilon_r}} \frac{K(k)}{K(\sqrt{1-k^2})};$$

$$k^2 = \frac{hq}{(w+q)(h-w)};$$

$$K(k) = \int_0^{\frac{\pi}{2}} \frac{1}{\sqrt{1-k\sin^2\theta}}\, d\theta = \int_0^1 \frac{1}{\sqrt{(1-t^2)(1-kt^2)}}\, dt;$$

$$q = \mathrm{Re}\left[-\cos\frac{\pi(-j\pi + \ln r_i - \ln[-e^{-j\phi} r_o])}{\ln r_i - \ln r_o}\right];$$

$$w = \mathrm{Re}\left[\cos\frac{\pi(j\pi + \ln[-r_i] - \ln r_i)}{\ln r_o - \ln r_i}\right]; \text{ and}$$

$$w - h = \mathrm{Re}\left[\cos\frac{\pi(j\pi - \ln r_i + \ln[-r_o])}{\ln r_o - \ln r_i}\right].$$

23. The antenna of claim 1, wherein said outer conductor cross-section lies in said plane of said inner conductor cross-section.

24. An antenna, said antenna having a cross-section comprising:

a circular inner conductor having a radius $r_i$ about an axis of the antenna that is perpendicular to a plane of the cross-section;

a donut shaped dielectric having an inner surface that surrounds said inner conductor; and an outer conductor having circular arc shape and coupled to an outer surface of said dielectric, said arc shape covering a sector angle $\phi$, wherein said sector angle $\phi$ increases in a continuous fashion along said axis from a minimum at an input of said antenna to a maximum at an output of said antenna.

25. The antenna of claim 24, wherein said sector angle $\phi$ determines an impedance profile of said antenna.

26. The antenna of claim 24, wherein said sector angle $\phi$ continuously varies so that an impedance along said axis is substantially constant along a length of said antenna.

27. The antenna of claim 24, wherein a dielectric constant of said dielectric substantially matches a dielectric constant of a target medium.

28. The antenna of claim 24, wherein said outer surface of said dielectric has a substantially cone-like shape along sad axis of said antenna.

29. An antenna, comprising:

a inner conductor having a cylinder shape;

a dielectric having an inner surface and an outer surface, said inner surface coupled to an outer surface of said inner conductor, and said outer surface having substantially a cone shape; and an outer conductor conformally attached to said outer surface of said dielectric and having substantially a triangular shape on said outer surface of said dielectric;

wherein an input of said antenna is applied at a vertex of said triangular shape of said outer conductor.

30. The antenna of claim 29, wherein in a cross-section of said antenna, said outer conductor defines an arc having a sector angle $\phi$ that varies in a continuous fashion along an axis of said antenna.

31. The antenna of claim 30, wherein said sector angle $\phi$ determines an impedance along said axis of said antenna.

32. The antenna of claim 30, wherein said sector angle $\phi$ varies so that an impedance along said axis is substantially constant along a length of said antenna.

33. A system for detecting objects behind a barrier, the system comprising:

transmitter means for generating an electromagnetic signal;

receiver means for receiving a reflected version of said electromagnetic signal; and an antenna coupled to said transmitter means and said receiver means, said antenna comprising, an inner conductor having a substantially circular cross-section with a radius $r_i$ about an axis of said antenna that is perpendicular to a plane of said cross-section, an outer conductor coupled to said transmitter means and having a cross-section that is substantially a circular arc about said axis, said arc covering a sector angle $\phi$ and having a radius $r_o$ that is greater than said radius $r_i$, and a second outer conductor, coupled to said receiver means, having a cross-section that is substantially a second circular arc about said axis, said second circular arc having said radius $r_o$.

34. The system of claim 33, wherein said electromagnetic signal is an impulse radio signal.

35. The system of claim 34, wherein said impulse radio signal is a Gaussian monocycle.

36. An antenna, comprising:

an inner reference conductor having a substantially circular cross-section with a radius $r_i$ about an axis that is perpendicular to a plane of said cross-section; and an outer radiating conductor having a cross-section that is substantially a circular arc about said axis, said arc covering a sector angle $\phi$ and having a radius $r_o$ that is greater than said radius $r_i$, wherein said sector angle $\phi$ is less than 360 degrees;

wherein an input of said antenna is applied at a vertex of said outer conductor.

37. The antenna of claim 36, wherein said sector angle $\phi$ varies in a continuous fashion along said axis.

38. The antenna of claim 37, wherein said continuously variable sector angle $\phi$ provides a substantially constant impedance profile along said axis.

39. The antenna of claim 36, wherein said sector angle $\phi$ increases from $\phi_1$ to $\phi_2$ along said axis.

40. The antenna of claim 36, further comprising a dielectric between said inner conductor and said outer conductor.

41. An antenna, comprising:

a inner conductor having a cylinder shape;

a dielectric having an inner surface and an outer surface, said inner surface coupled to an outer surface of said inner conductor, and said outer surface having substantially a cone shape; and an outer conductor conformally attached to said outer surface of said dielectric and having substantially a triangular shape;

wherein in a cross-section of said antenna, said outer conductor defines an arc having a sector angle $\phi$ that varies so that an impedance along an axis of said antenna is substantially constant wherein an input of the antenna is applied at a vertex of said triangular shape of said outer conductor.

42. An antenna, comprising:

an inner ground conductor having a substantially circular cross-section with a radius $r_i$ about an axis that is perpendicular to a plane of said cross-section;

a first outer radiating conductor having a cross-section that is substantially a circular arc about said axis, said arc covering a sector angle $\phi_1$ and having a radius $r_0$ that is greater than said radius $r_i$, said first outer radiating conductor having an input at a vertex of said first outer radiating conductor; and a second outer radiating conductor having a substantially circular arc cross-section about said axis, said second outer conductor arc having said radius $r_o$, and having a sector angle $\phi_2$, said second outer radiating conductor having an input at a vertex if said second outer radiating conductor.

43. The antenna of claim 42, wherein said sector angle $\phi_2$ is substantially equal to said sector angle $\phi_1$.

44. The antenna of claim 42, wherein said outer conductor transmits an EM signal, and wherein said second outer conductor receives a reflected version of said transmitted EM signal.

45. The antenna of claim 42, wherein said second outer conductor is rotated around said axis by a rotation angle relative to said outer conductor.

46. The antenna of claim 45, wherein said rotation angle is approximately 120 degrees.

47. An antenna, comprising:

an inner conductor having a substantially circular cross-section with a radius $r_i$ about an axis of the antenna that is perpendicular to a plane of said cross-section; and an outer conductor having a cross-section that is substantially a circular arc about said axis, said arc covering a sector angle $\phi$ and having a radius $r_o$ that is greater than said radius $r_i$, wherein said sector angle $\phi$ varies in a continuous fashion along said axis;

wherein said continuously variable sector angle $\phi$ decreases from a maximum at input of said antenna to a minimum at an output of said antenna.

48. An antenna, comprising:

an inner conductor having a substantially circular cross-section with a radius $r_i$ about an axis of the antenna that is perpendicular to a plane of said cross-section;

49. The antenna of claim 48, wherein said Em signal is an impulse radio signal.

50. An antenna, comprising:

an inner conductor having a substantially circular cross-section with a radius $r_i$ about an axis of the antenna that is perpendicular to a plane of said cross-section; and an outer conductor having a cross-section that is substantially a circular arc about said axis, said arc covering a sector angle $\phi$ and having a radius $r_o$ that is greater than said radius $r_i$, wherein said sector angle $\phi$ varies in a continuous fashion along said axis;

wherein said outer conductor transmits an EM signal, and wherein said second outer conductor receives a reflected version of said transmitted EM signal.

51. An antenna, comprising:

an inner conductor having a substantially circular cross-section with a radius $r_i$ about an axis of the antenna that is perpendicular to a plane of said cross-section; and an outer conductor having a cross-section that is substantially a circular arc about said axis, said arc covering a sector angle $\phi$ and having a radius $r_o$ that is greater than said radius $r_i$, wherein said sector angle $\phi$ varies in a continuous fashion along said axis;

wherein an impedance of said antenna is determined according to the following system of equations, comprising:

$$Z = \frac{Z_0}{\sqrt{\varepsilon_r}} \frac{K(k)}{K\left(\sqrt{1-k^2}\right)};$$

$$k^2 = \frac{hq}{(w+q)(h-w)};$$

$$K(k) = \int_0^{\frac{\pi}{2}} \frac{1}{\sqrt{1-k\sin^2\theta}}\, d\theta = \int_0^1 \frac{1}{\sqrt{(1-t^2)(1-kt^2)}}\, dt;$$

$$q = \mathrm{Re}\left[-\cos\frac{\pi(-j\pi + \ln r_i - \ln[-e^{-j\phi} r_o])}{\ln r_i - \ln r_o}\right];$$

$$w = \mathrm{Re}\left[\cos\frac{\pi(j\pi + \ln[-r_i] - \ln r_i)}{\ln r_o - \ln r_i}\right]; \text{ and}$$

$$w - h = \mathrm{Re}\left[\cos\frac{\pi(j\pi - \ln r_i + \ln[-r_o])}{\ln r_o - \ln r_i}\right].$$

52. An antenna, said antenna having a cross-section comprising:

a circular inner conductor having a radius $r_i$ about an axis of the antenna that is perpendicular to a plane of the cross-section;

a donut shaped dielectric having an inner surface that surrounds said inner conductor; and an outer conductor having circular arc shape and coupled to an outer surface of said dielectric, said arc shape covering a sector angle $\phi$, wherein said sector angle $\phi$ varies in a continuous fashion along said axis;

wherein a dielectric constant of said dielectric substantially matches a dielectric constant of a target medium.

53. An antenna, comprising:

an inner ground conductor having a substantially circular cross-section with a radius $r_i$ about an axis that is perpendicular to a plane of said cross-section;

a first outer radiating conductor having a cross-section that is substantially a circular arc about said axis, said arc covering a sector angle $\phi_1$ and having a radius $r_o$ that is greater than said radius $r_i$; and a second outer radiating conductor having a substantially circular arc cross-section about said axis, said second outer conductor arc having said radius $r_o$, and having a sector angle $\phi_2$;

wherein said outer conductor transmits an EM signal, and wherein said second outer conductor receives a reflected version of said transmitted EM signal.

* * * * *